US006608549B2

(12) United States Patent
Mynatt et al.

(10) Patent No.: US 6,608,549 B2
(45) Date of Patent: Aug. 19, 2003

(54) VIRTUAL INTERFACE FOR CONFIGURING AN AUDIO AUGMENTATION SYSTEM

(75) Inventors: Elizabeth D. Mynatt, San Francisco, CA (US); Maribeth Back, San Francisco, CA (US); Roy Want, Los Altos, CA (US); Jason Ellis, Brewster, NY (US); W. Keith Edwards, San Francisco, CA (US); Maureen C. Stone, Los Altos, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/127,271

(22) Filed: Jul. 31, 1998

(65) Prior Publication Data

US 2002/0149470 A1 Oct. 17, 2002

Related U.S. Application Data

(63) Continuation-in-part of application No. 09/045,447, filed on Mar. 20, 1998.

(51) Int. Cl.[7] ..... G06B 7/06; H04R 3/02

(52) U.S. Cl. ..... 340/5.8; 345/302; 381/73.1

(58) Field of Search ..... 340/10.1, 825.31, 340/825.34, 5.8, 10.42, 7.21, 825.49, 944; 380/258; 707/500.1; 345/757; 367/132; 381/73.1, 173

(56) References Cited

U.S. PATENT DOCUMENTS

| | | | | | |
|---|---|---|---|---|---|
| 4,081,617 | A | | 3/1978 | Clark | |
| 4,395,600 | A | * | 7/1983 | Lundy et al. | 381/73.1 |
| 5,402,469 | A | | 3/1995 | Hopper et al. | |
| 5,469,511 | A | * | 11/1995 | Lewis et al. | 381/173 |
| 5,479,408 | A | | 12/1995 | Will | |
| 5,485,634 | A | | 1/1996 | Weiser et al. | |
| 5,493,283 | A | | 2/1996 | Hopper et al. | |
| 5,493,693 | A | | 2/1996 | Tanaka et al. | |
| 5,508,699 | A | * | 4/1996 | Silverman | |
| 5,530,235 | A | | 6/1996 | Stefik et al. | |
| 5,544,321 | A | | 8/1996 | Theimer et al. | |
| 5,555,376 | A | | 9/1996 | Theimer et al. | |
| 5,564,070 | A | | 10/1996 | Want et al. | |
| 5,572,033 | A | | 11/1996 | Grant | |
| 5,603,054 | A | | 2/1997 | Theimer et al. | |
| 5,611,050 | A | | 3/1997 | Theimer et al. | |
| 5,627,517 | A | | 5/1997 | Theimer et al. | |
| 5,659,691 | A | * | 8/1997 | Durward et al. | 367/132 |
| 5,661,699 | A | * | 8/1997 | Sutton | 345/757 |
| 5,784,546 | A | * | 7/1998 | Benman, Jr. | 395/154 |

OTHER PUBLICATIONS

Benjamin B. Bederson et al., "Computer–Augmented Environments: New Places To Learn, Work, and Play", Advances In Human Computer Interaction, vol. 5, Ch. 2, pp. 37–66, 1995.

"Projects From Beyond The Grave: Intermezzo", http://www.parc.xerox.com/csl/members/kedwards/intermezzo.html, 2 pages.

W. Keith Edwards, "Coordination Infrastructure In Collaborative Systems", Georgia Institute of Technology, College of Computing, Atlanta, GA, pp. 1–148, Dec. 1995 (obtained via the Internet).

(List continued on next page.)

*Primary Examiner*—Michael Horabik
*Assistant Examiner*—William Bangachon
(74) *Attorney, Agent, or Firm*—Fay, Sharpe, Fagan, Minnich & McKee, LLP

(57) ABSTRACT

A virtual interface is provided which allows a user to navigate through a representation of a physical target area, such as an office, school or home environment. Using the virtual interface, a user can alter the configuration of a system which transmits information to users via peripheral or background auditory cues in response to physical actions of the users in the environments.

15 Claims, 15 Drawing Sheets

OTHER PUBLICATIONS

W. Keith Edwards, "Coordination Infrastructure In Collaborative Systems", Georgia Institute of Technology, College of Computing, Atlanta, GA, pps. 1–175, Dec. 1995 (obtained from Georgia Tech Library).

W. Keith Edwards, "Policies and Roles in Collaborative Applications", Proceedings of the ACM Conference on Computer–Supported Cooperative Work (CSCW), Boston, MA, 10 pages, 1996.

W. Keith Edwards, "Session Management For Collaborative Applications", Proceedings of the ACM Conference on Computer–Supported Cooperative Work (CSCW), Chapel Hill, NC, 8 pages, 1994.

W. Keith Edwards, "Representing Activity in Collaborative Systems", Proceedings of the Sixth IFIP Conference on Human Computer Interaction (Interact), Sydney, Australia, 8 pages, 1997.

*Computer Art and Music*, Chapter 8—Inputs and Controls, pp. 234–240.

Elizabeth D. Mynatt et al., *Audio Aura: Light–Weight Audio Augmented Reality*, ICAD '97, Nov. 1997, pp. 105–107.

Benjamin B. Bederson, *Audio Augmented Reality: A Prototype Automated Tour Guide*; ACM Human Computer in Computing Systems Conference (CHI '95), pp. 210–211.

*Antenna Gallery Guide*, ANTENNA, Sep. 1996.

Nitin Sawhney, *Situational Awareness from Environmental Sounds*, Jun. 13, 1997.

Mark Weiser, *Some Computer Science Issues in Ubiquitous Computing*, Communications of the ACM, Jul. 1993, vol. 36, No. 7, pp. 75–84.

E.D. Mynatt, *Two Cases for Awareness: As Thread for Long–Term Collaboration and as Fodder for Forming Tacit Knowledge*, Workshop on Awareness in Collaborative Systems (CHI '97), Mar. 23, 1997.

E.D. Mynatt, *Workshop on Ubiquitous Computing* (CHI '97), Mar. 23, 1997.

E.D. Mynatt et al., *Audio Aura: Light–Weight Audio Augmented Reality*, ACM Annual Symposium on User Interface Software and Technology, Oct. 17, 1997.

E.D. Mynatt et al., *Designing Audio Aura*, CHI '98, Apr. 1998.

Tangible Bits: Towards Seamless Interfaces between People, Bits & Atoms (Proceedings of CHI/97, Mar. 22–27, 1997).

Audio Augmented Reality: A Prototype Automated Tour Guide (Bell Communications Research, CHI/95).

Advances in Human–Computer Interaction (Nielsen, 1995).

Electronic Mail Previews Using Non–Speech Audio (Hudson & Smith, CHI/96).

Effective Sounds in Complex Systems: The Arkola Simulation (Gaver, Smith & O'Shea, 1991/ACM).

Aroma: Abstract Representation of Presence Supporting Mutual Awareness (Pedersen & Sokoler, CHI/97).

Bauersfeld, Bennett & Lynch, "Striking a Balance", CHI '92 Conference Proceedings, ACM Conference on Human Factors in Computing Systems, May 3–7, 1992 (Monterey, California).

Want, Hopper, Falcao & Gibbons, "The Active Badge Location System", ACM Transactions on Information Systems, vol. 10, No. 1, Jan. 1992, pp. 91–102.

Lenny Foner, MIT Media Laboratory, "Artificial Synesthesia via Sonification: A Wearable Augmented Sensory System", http://www.santafe.edu/~icad/ICAD96/proc96/foner.htm.

ACM Siggraph and ACM Sigchi, "UIST '95, Eight annual Symposium on User Interface Software and Technology", Pittsburgh, PA, Nov.14–17, 1995.

* cited by examiner

FIG. 5
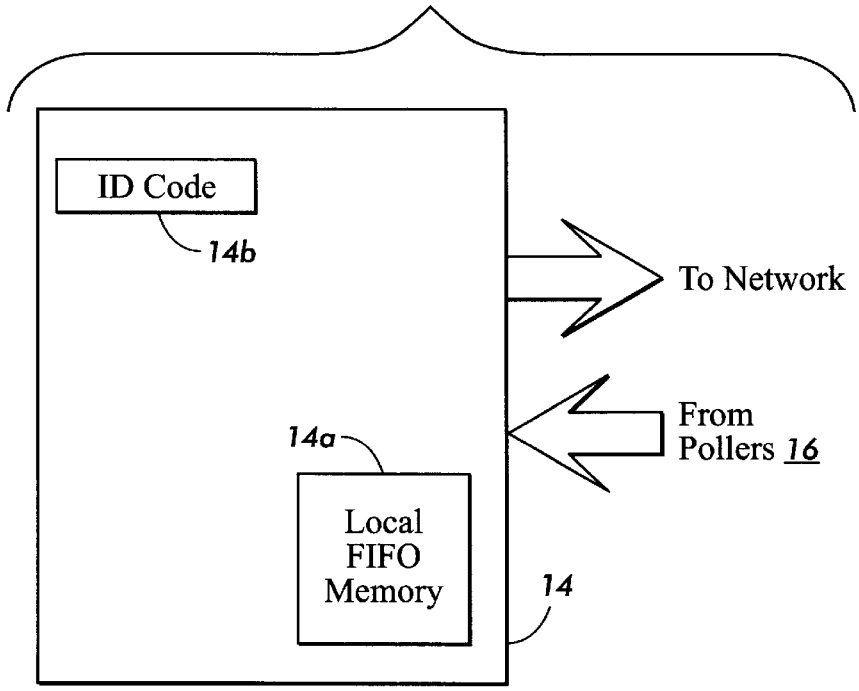
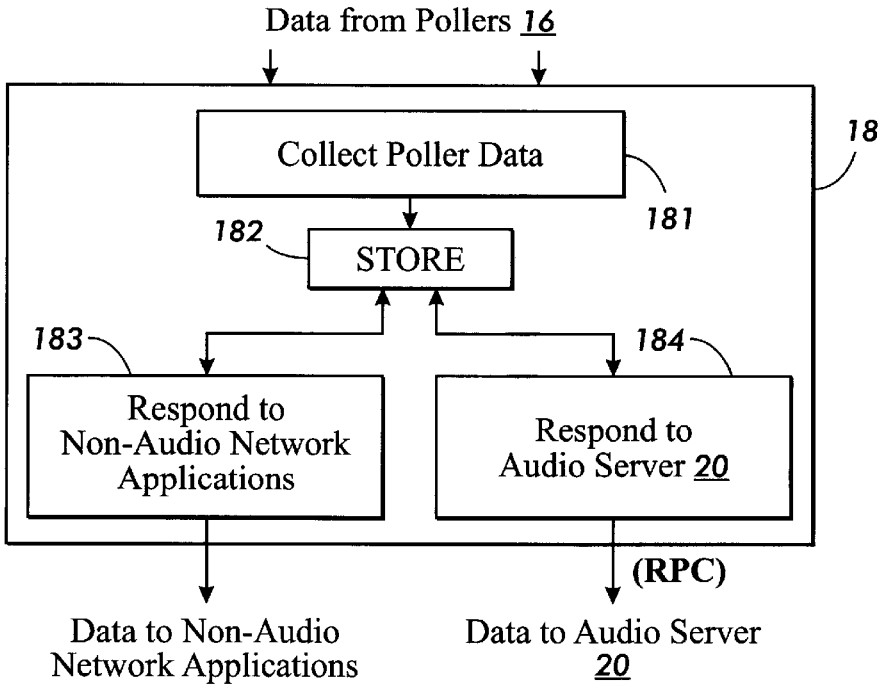
FIG. 6

FIG. 11
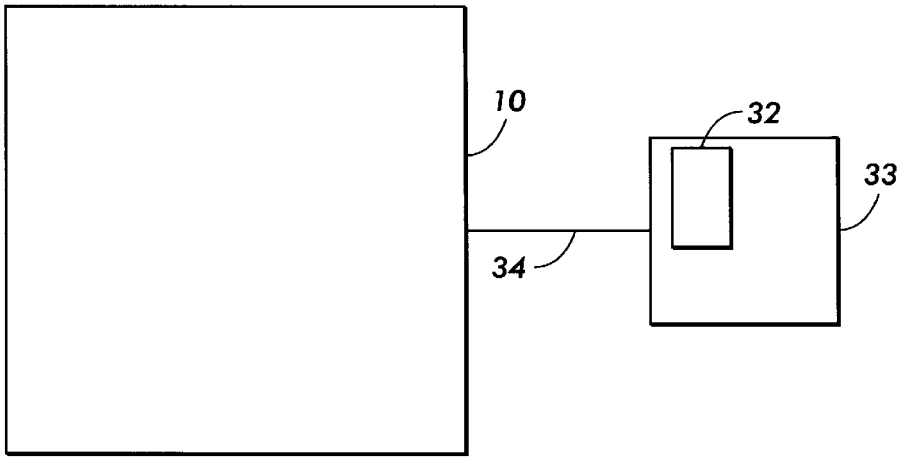
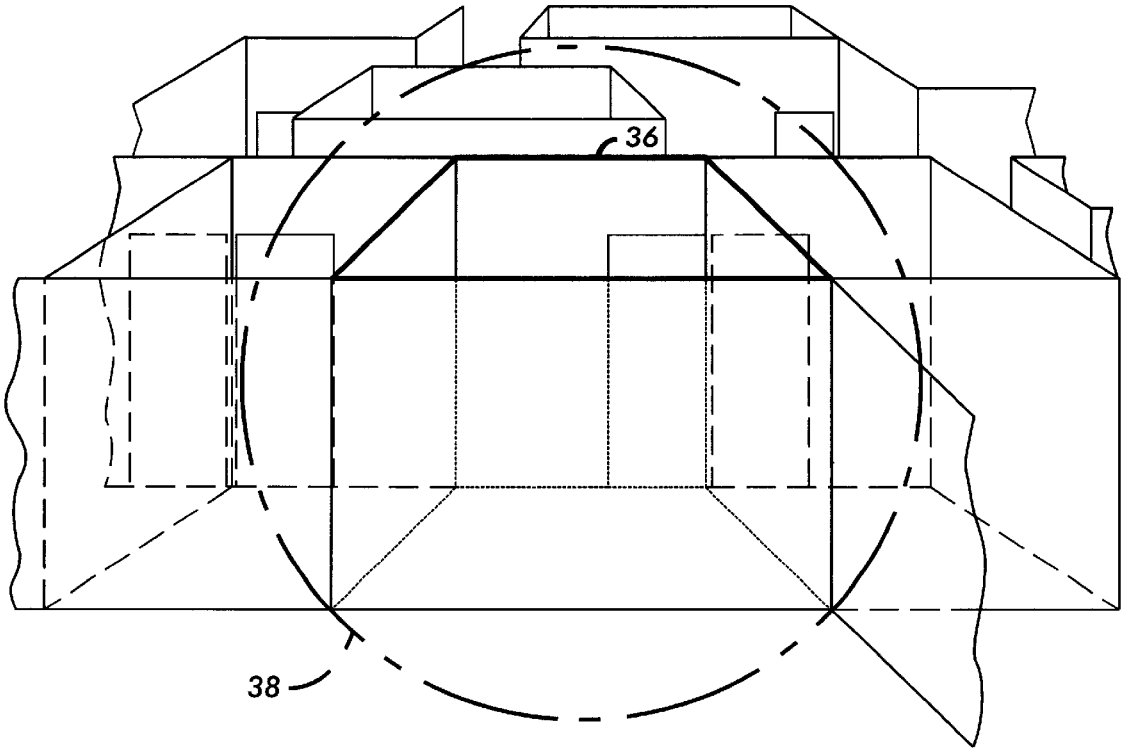
FIG. 12

$Sensor_1$ (Location) – Email Service
$Sensor_2$ (Location) – Group Service
$Sensor_3$ (Location) – Vmail Service
⋮
$Sensor_n$ (Location) – Email Service Vmail Service – Bells
(Small) Email Service – Sea Gull
(Large) Email Service – Flock of Gulls
⋮
Group Service – Waves

VIRTUAL INTERFACE FOR CONFIGURING AN AUDIO AUGMENTATION SYSTEM

This is a continuation-in-part of U.S. Ser. No. 09/045,447 filed Mar. 20, 1998.

NOTICE

A portion of the disclosure (e.g. Appendix A) of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

This invention relates to a system for providing unique audio augmentation of a physical environment to users. More particularly, the invention is directed to an apparatus and method implementing the transmission of information to the users—via peripheral, or background, auditory cues—in response to the physical but implicit or natural action of the users in a particular environment, e.g., the workplace. The system in its preferred form combines three known technologies: active badges, distributed systems, and digital audio delivered via portable wireless headphones.

While the invention is particularly directed to the art of audio augmentation of the physical workplace, and will be thus described with specific reference thereto, it will be appreciated that the invention may have usefulness in other fields and applications.

Considering the richness and variety of activities in the typical workplace, interaction with computers is relatively limited and explicit. Such interaction is primarily limited to typing and mousing into a box while seated at a desk. The dialogue with the computer is explicit. That is, we enter in commands and the computer responds.

Part of the reason that interaction with computers is relatively mundane is that computers are not particularly well designed to match the variety of activities of the typical human being. For example, we walk around, get coffee, retrieve the mail, go to lunch, go to conference rooms and visit the offices of co-workers. Although some computers are now small enough to travel with users, such computers do not take advantage of physical actions.

It would be advantageous to leverage everyday physical activities. For example, an opportune time to provide serendipitous, yet useful, information by way of peripheral audio is when a person is walking down the hallway. If the person is concentrating on their current task, he/she will likely not even notice or attend to the peripheral audio display. If, however, the person is less focused on a particular task, he/she will naturally notice the audio display and perhaps decide to attend to information posted thereon.

Additionally, it would be advantageous if physical actions could guide the information content. For example, a pause at a co-worker's empty office is an opportune time for the user to hear whether their co-worker has been in the office earlier that day.

Unfortunately, known systems do not provide for these types of interactions with computer systems. Most work in augmented reality systems has focused on augmenting visual information by overlaying a visual image of the environment with additional information, usually presented as text. A common configuration of these systems is a hand-held device that can be pointed at objects in the environment. A video image with overlays is displayed in a small window.

These types of hand-held systems have two primary disadvantages. First, users must actively probe the environment. The everyday pattern of walking through an office does not trigger the delivery of useful information. Second, users only view a representation of the physical world, and cannot continue to interact with the physical world.

Providing auditory cues based on the motion of users in a physical environment has also been explored by researchers and artists, and is currently used for gallery and museum tours. These include a system described by Bederson, et al., "Computer Augmented Environments: New Places to Learn, Work and Play", in *Advances in Human Computer Interaction*, Vol. 5, Ablex Press. Here, a linear, usually cassette-based audio tour is replaced by a non-linear sensor-based digital audio tour, allowing the visitor to choose their own path through a museum. A commercial version of the Bederson system is believed to be produced under the name Antenna Galley Circle™.

Several disadvantages of this system exist. First, in Bederson's system, users must carry the digital audio with them, imposing an obvious constraint on the range and generation of audio cues that can be presented. Second, Bederson's system is unidirectional. It does not send information from a user to the environment such as the identity, location, or history of the particular user.

Other investigations into audio awareness include Hudson, et al., "Electronic Mail Previews Using Non-Speech Audio", *CHI '96 Conference Companion*, ACM, pp. 237–238, who demonstrated providing iconic auditory summaries of newly arrived e-mail when a user flashed a colored card while walking by a sensor. This system still required active input from the user and only explored one use of audio in contrast to creating an additional auditory environment that does not require user input.

Explorations in providing awareness data and other forms of serendipitous information illustrate additional possible scenarios in this design space. Ishii et al. 's "Tangible Bits: Towards Seamless Interfaces Between People, Bits and Atoms", in *Proc. CHI'97*, ACM, March 1997, focuses on surrounding people in their office with a wealth of background awareness cues using light, sound and touch. This system does not follow the user outside of their office and does not provide for the triggering of awareness cues based on the activities of the user.

Gaver et al., "Effective Sound in Complex Systems: The ARKola Simulation", *Proc. CHI'91*, ACM Press, pp. 85–90, explored using auditory cues in monitoring the state of a mock bottling plant. Pederson et al., "AROMA: Abstract Representation of Presence Supporting Mutual Awareness", *Pro. CHI'97*, ACM Press, 51–58, has also explored using awareness cues to support awareness of other people.

Another area of computing that relates generally to electronically monitoring information concerning users and machines, including state and locational or proximity information, is called "ubiquitous" computing. The ubiquitous computing known, however, does not take advantage of audio cues on the periphery of the perception of humans.

The following U.S. patents commonly owned by the assignee of the present invention generally relating to ubiquitous computing are incorporated herein by reference:

| U.S. Pat. No. | Inventor | Issue Date |
|---|---|---|
| 5,485,634 | Weiser et al. | Jan. 16, 1996 |
| 5,530,235 | Stefik et al. | Jun. 25, 1996 |
| 5,544,321 | Theimer et al. | Aug. 6, 1996 |
| 5,555,376 | Theimer et al. | Sep. 10, 1996 |
| 5,564,070 | Want et al. | Oct. 8, 1996 |
| 5,603,054 | Theimer et al. | Feb. 11, 1997 |
| 5,611,050 | Theimer et al. | Mar. 11, 1997 |
| 5,627,517 | Theimer et al. | May 6, 1997 |

Therefore, it would be advantageous if a system was provided that: 1) transmitted useful information to a user via peripheral audio cues, such transmission being triggered by the passive interaction of the user in, for example, the workplace, 2) allowed the user to continue to interact in the physical environment, physically uninterrupted by the transmission, 3) allowed the user to carry only lightweight communication hardware such as badges and wireless headphones or earphones instead of more constraining devices such as hand held processors or CD players and the like, and 4) accomplished and manipulated bidirectional communication between the user and the system.

It has also been considered to be advantageous to provide a user interface to the audio aura system to allow convenient configuration by a user to suit his/her needs.

The present invention contemplates a new audio augmentation system which achieves the above-referenced advantages, and others, and resolves appurtenant difficulties.

SUMMARY OF THE INVENTION

In the parent patent application, U.S. Ser. No. 09/045,447, audio is shown to be used to provide information that lies on the edge of background'awareness. Humans naturally use their sense of hearing to monitor the environment, e.g., hearing someone approaching, hearing someone saying a name, and hearing that a computer's disk drive is spinning. While in the midst of some conscious action, ears are gathering information that persons may or may not need to comprehend.

Accordingly, audio (primarily non-speech audio) is a natural medium to create a peripheral display in the human mind. A goal of the parent application, U.S. Ser. No. 09/045,447 is thus to leverage these natural abilities and create an interface that enriches the physical world without being distracting to the user.

The U.S. Ser. No. 09/045,447 also describes a system designed to be serendipitous. That is, the information is such that one appreciates it when heard, but does not necessarily rely on it in the same way that one relies on receiving a meeting reminder or an urgent page. The reason for this distinction should be clear. Information that one relies on must penetrate beyond a user's peripheral perceptions to ensure that it has been perceived. This, of course, does not imply that serendipitous information is not of value. Conversely, many of our actions are guided by the wealth of background information in our environment. Whether we are reminded of something to do, warned of difficulty along a potential path, or simply provided the spark of a new idea, opportunistic use of serendipitous information makes lives more efficient and rich. The goal of the U.S. Ser. No. 09/045,447 is to provide useful, serendipitous information to users by augmenting the environment via audio cues in the workplace.

Thus, in accordance with U.S. Ser. No. 09/045,447, a system and method for providing unique audio augmentation of a physical environment is implemented. An active badge is worn by a user to repeatedly emit a unique infrared signal detected by a low cost network of infrared sensors placed strategically around a workplace. The information from the infrared sensors is collected and combined with other data sources, such as on-line calendars and e-mail cues. Audio cues are triggered by changes in the system (e.g. movement of the user from one room to another) and sent to the user's wireless headphones.

In accordance with the present invention, a virtual representation of a target area, such as an office, school, home is generated, and includes representation of sensors for the audio aura system. A virtual interface is designated to include the generation of cues to indicate when, through navigation of the target area, a user is within a range to interact with a sensor representation. The visual cue includes an indication of the association between sensors and service routines, and an indication of a capability for user interaction with the sensor representation. Further, the virtual interface connects to the audio aura system via a data link whereby data input by a user through the virtual interface is transmitted to the audio aura system.

Further scope of the applicability of the present invention will become apparent from the detailed description provided below. It should be understood, however, that the detailed description and specific examples, while indicating preferred embodiments of the invention, are given by way of illustration only, since various changes and modifications within the spirit of the scope of the invention will become apparent to those skilled in the art.

DESCRIPTION OF THE DRAWINGS

The present invention exists in the construction, arrangement, and combination of the various parts of the device and steps of the methods, whereby the objects contemplated are attained as hereinafter more fully set forth, and specifically pointed out in the claims, and illustrated in the accompanying drawings in which:

FIG. 5 is a functional diagram illustrating a sensor according to the present invention;

FIG. 6 is a functional block diagram illustrating a location server of the present invention;

FIG. 11 is a block diagram showing the virtual interface connected to the audio or a system via data links;

FIG. 12 is an illustration of sensor coverage for a target area;

DETAILED DESCRIPTION OF THE PREFERRED EMBODIMENTS

Figure 1:
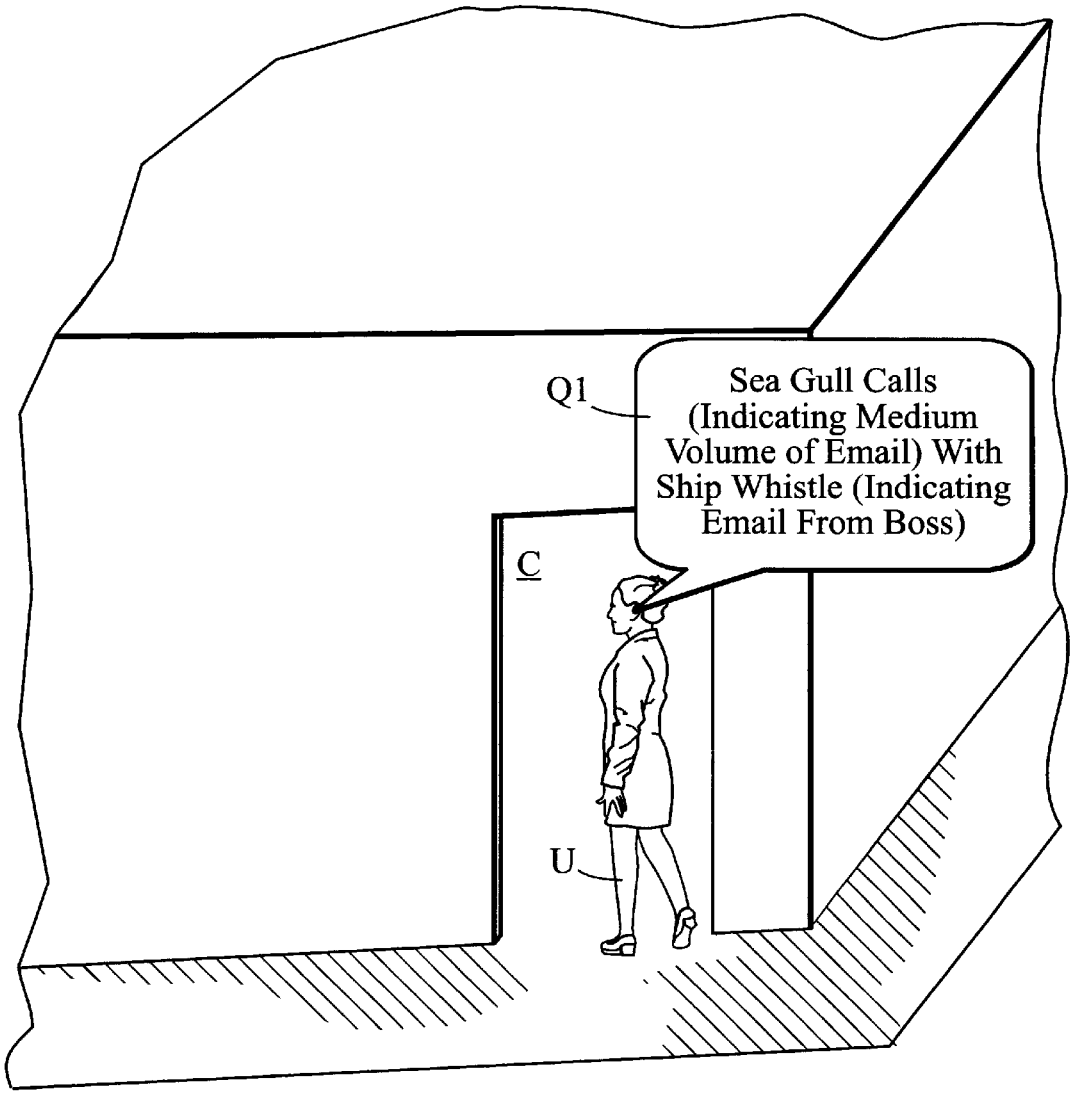
FIG. 1 is an illustration of an exemplary application of the present invention.

Before describing the details of the present invention, it is important to note that the preferred embodiment takes into account a number of scenarios that were devised based on observation. These scenarios primarily touch on issues in system responsiveness, privacy, and the complexity and abstractness of the information presented. Each scenario grew out of a need for different types of serendipitous information. Three such scenarios are exemplary.

First, the workplace can often be an e-mail oriented culture. Whether there is newly-arrived e-mail, who it is from and what it concerns are often important. Workers typically run by their offices between meetings to check on this important information pipeline.

Another common between-meeting activity is entering the "bistro", or coffee lounge, to retrieve a cup of coffee or tea. An obvious tension experienced by workers is whether to linger with a cup of coffee and chat with colleagues or return to one's office to check on the latest e-mail messages. The present invention ties these activities together. When a user enters the bistro, an auditory cue is transmitted to the user that conveys approximately how many new e-mail messages have arrived and indicates the source of the messages from particular individuals and/or groups.

Second, workers tend to visit the offices of co-workers. This practice supports communication when an e-mail message or phone call might be inappropriate or too time consuming. When a visitor is faced with an empty office, he/she may quickly survey the office trying to determine if the desired person has been in that day.

With the present system, when the user enters the office of the coworker, an auditory cue is transmitted to the user indicating whether the coworker has been in that day, whether the coworker has been gone for some time, or whether the coworker just left the office. It is important to note that in one embodiment these transmitted auditory cues are preferably only qualitative. For example, the cues do not report that "Mr. X has been out of the office for two hours and forty-five minutes." The cues—referred to as "footprints" or location cues—merely give a sense to the user that is comparable to seeing an office light on or a briefcase against the desk or hearing a passing colleague report that the coworker was just seen walking toward a conference room.

Third, many workers are not physically located near co-workers in a particular work group. Thus, these workers do not share a palpable sense of their work group's activity—the group pulse—as compared to the sense of activity shared by a work group that is co-located. In this scenario, various bits of information about individuals in a group become the basis for an abstract representation of a "group pulse." Whether people are in the office that day, if they are working with shared artifacts, or if a subset of them are collaborating in a face-to-face meeting triggers changes in this auditory cue. As a continuous sound, the group pulse becomes a backdrop for other system cues.

It is recognized, of course, that the audio aura system is not limited to only these three scenarios. These are merely examples of suitable implementations of the invention. Other applications would clearly fall within the scope of the audio aura system. For example, the audio aura system could be applied to serve as a reminder to a user to speak with another individual once that individual comes into close proximity. Another exemplary application might involve conveying new book title information to a user if the user remains in a location for a predetermined amount of time, e.g. standing near a bookshelf.

Several sets, or ecologies, of auditory cues for each of the three exemplary scenarios were created. Each sound was crafted with attention to its frequency content, structure, and interaction with other sounds. To explore a range of use and preference, four sound environments composed of one or more sound ecologies were created. The sound selections for e-mail quantity and the group pulse are summarized in Tables 1 and 2.

TABLE 1

Examples of sound design variations between types for e-mail quantity

| | Sound Effects | Music | Voice | Rich |
|---|---|---|---|---|
| Nothing new | a single gull cry | high, short bell melody, rising pitch at end | "You have no e-mail" | Same as SFX; a single gull cry |
| A little (1–5 new) | a gull calling a few times | high, somewhat longer melody, falling at end | "You have n new messages | a few gulls crying |
| Some (5–15 new) | a few gulls calling | lower, longer melody | "You have n new messages | a few gulls calling |
| A lot (more than 15 new) | gulls squabbling, making a racket | longest melody, falling at end | "You have n new messages" | gulls squabbling, making a racket |

TABLE 2

Examples of sound design variations for group pulse

| | Sound Effects | Music | Voice | Rich |
|---|---|---|---|---|
| Low activity | distant surf | vibe | none preferred but must be peripheral | combination of surf and vibe |
| Medium activity | closer waves | same vibe, with added sample at lower pitch | none preferred but must be peripheral | combination of closer waves and vibe |
| High activity | closer, more active waves | as above, three vibes at three pitches and rhythms | none preferred but must be peripheral | combination of waves and vibe, more active |

Similarly, sound design variations may be designated for the third exemplary use of the system 10, i.e. receiving an auditory cue (for example, buoy bells or other sound effects, music, voice or a combination thereof) when entering a coworker's office. As noted above, audio cues may be implemented that indicate whether the coworker is present that day, has been out for quite some time, or has just left the office.

Figure 2:
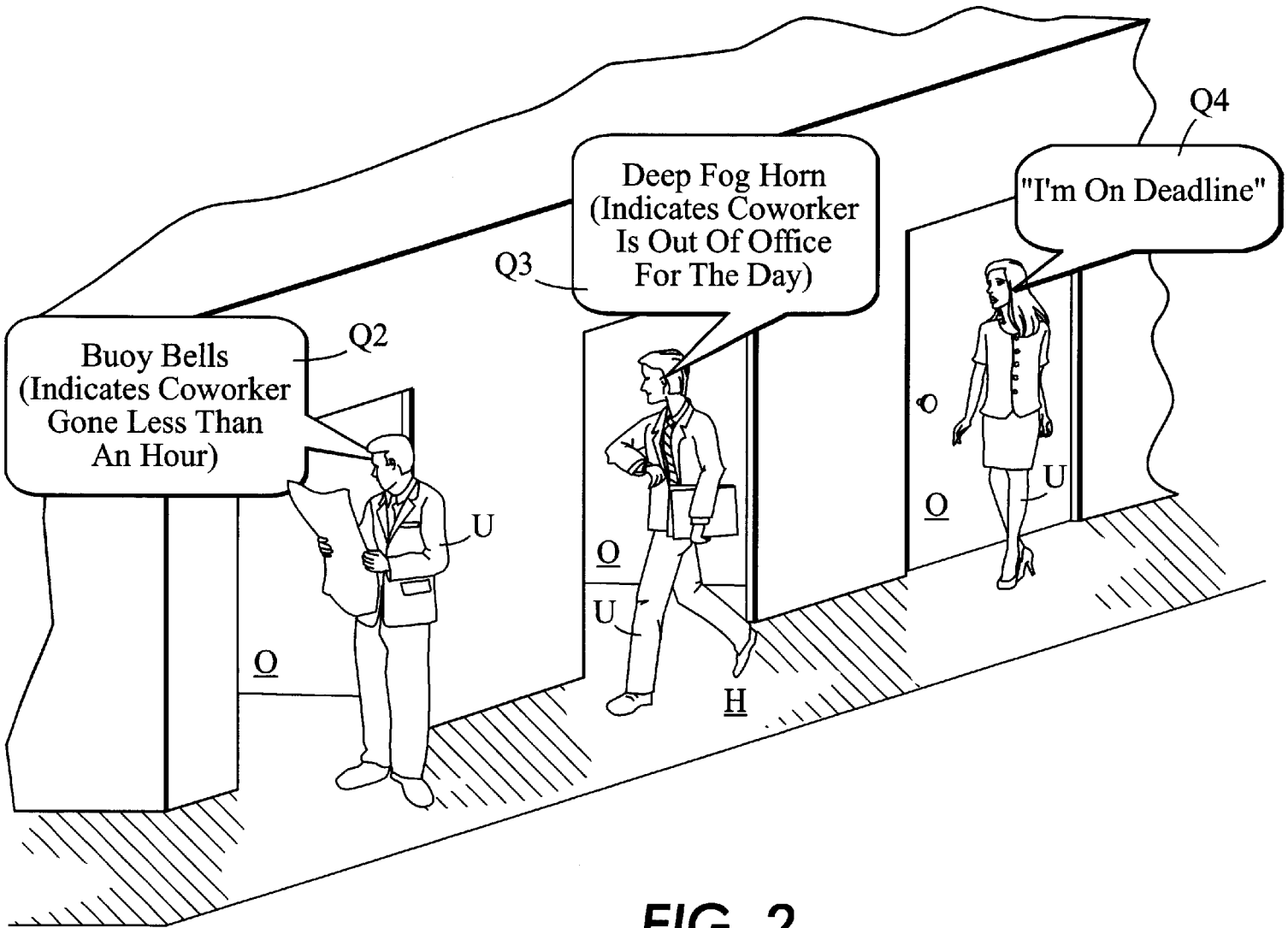
FIG. 2 is an illustration of another exemplary application of the present invention.
Figure 3:
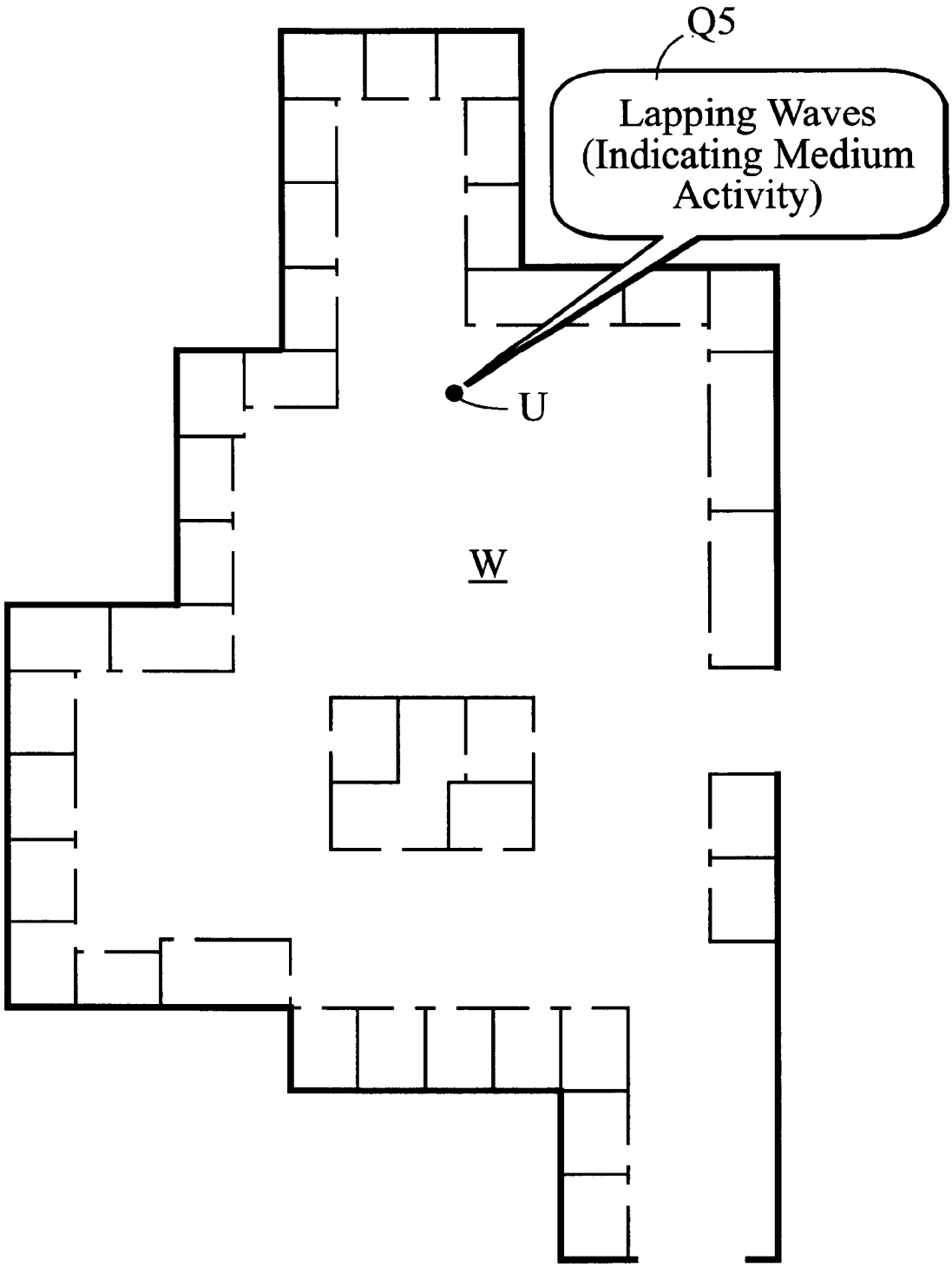
FIG.3 is an illustration of still yet another exemplary application of the present invention.

Referring now to the drawings wherein the showings are for purposes of illustrating the preferred embodiments of the invention only, and not for purposes of limiting same, FIGS. 1–3 illustrate the implementation of the above referenced exemplary applications of the present system. For example, as illustrated in FIG. 1, when a user U enters the coffee lounge C in the preferred embodiment, a sound file is triggered and an auditory cue Q1 is sent to the user's headphones (illustratively shown by a "balloon" in FIG. 1) that indicates the number of e-mail messages recently received and the content thereof. In FIG. 2, auditory cues Q2, Q3, Q4 (sent to the user's headphones and illustratively shown by the "balloons" in FIG. 2) indicating a variety of information are triggered by the user U when lingering at the threshold of doors of the offices O of co-workers. Referring to FIG. 3, the group pulse is monitored by the system and global proximity sensors trigger a group pulse sound file upon the user's entering of the workplace W and an auditory cue Q5 (illustratively shown as a "balloon" in FIG. 3) is sent to the user U. It will be understood that although text phrases indicate the meanings of Q1–Q5 in FIGS. 1–3, the actual auditory cues presented to the user can be, for example, music, sound effects, voice, or a rich combination thereof as shown in, for example, Tables 1 and 2 above.

Figure 4:
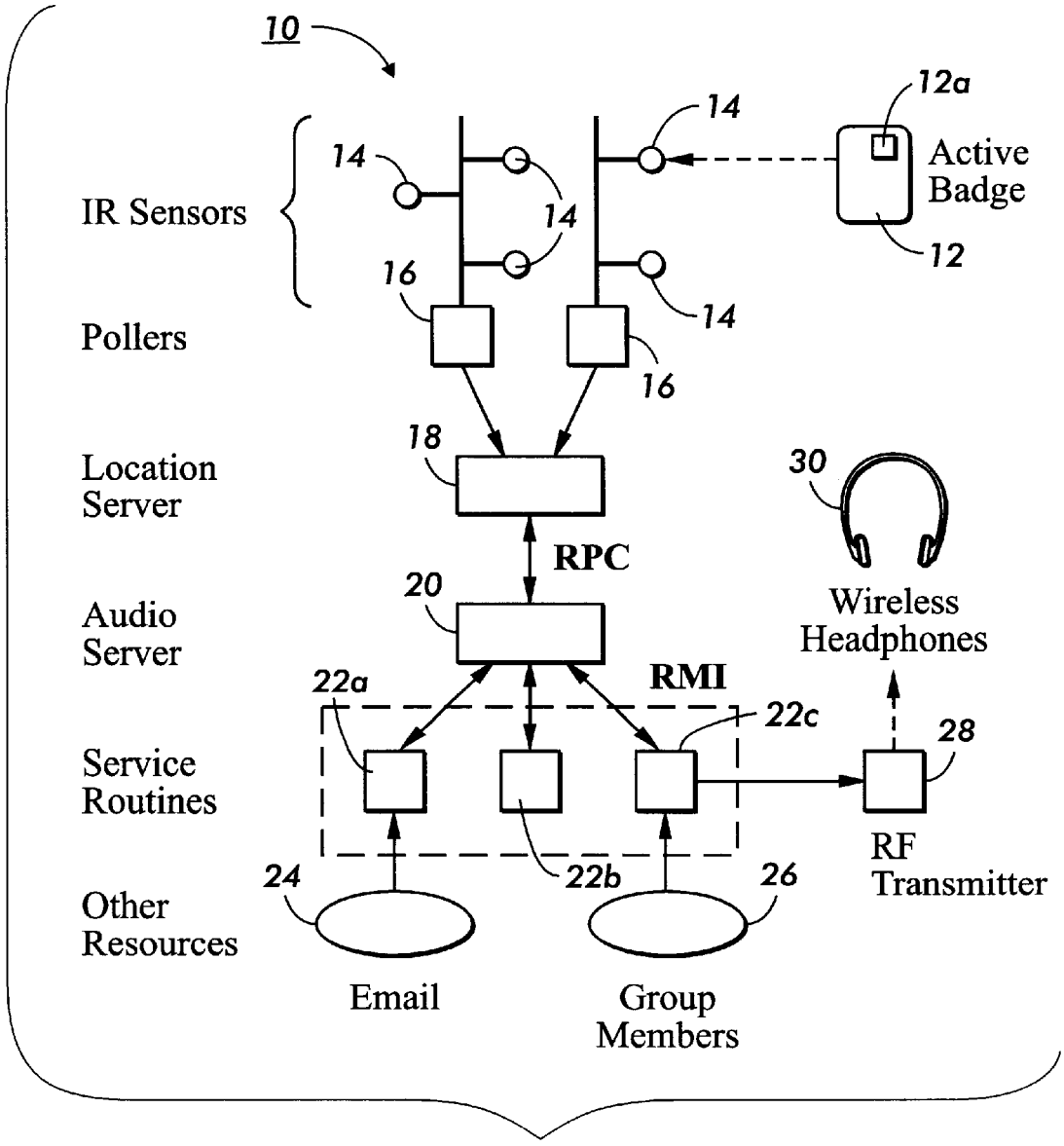
FIG. 4 is a block diagram illustrating the preferred embodiment of the present invention.

FIG. 4 is a block diagram illustrating the overall preferred embodiment. As shown, a system 10 is comprised of at least one active badge 12 and a plurality of sensors 14, preferably infrared (IR) sensors. The system further comprises pollers 16 that poll the sensors 14. Also included in the system is a location, or first, server 18 and an audio, or second, server 20. The audio server 20 communicates with exemplary service routines 22*a* (e-mail service routine), 22*b* (location or footprints service routine) and 22*c* (group pulse service routine). Other resources, such as an e-mail resource 24 and group member activity resource 26, may also be provided.

Output data from the service routines 22*a–c* may be transmitted through a transmitter 28 (preferably a radio frequency (RF) transmitter), which transmits data to the user via, for example, wireless headphones 30 that are worn by the users who are also wearing the active badges 12.

In addition, the system is provided with a virtual interface that allows the user to configure preselected portions of the system to suit his/her needs.

More particularly and with continuing reference to FIG. 4, the active badges such as active badge 12 are worn by users and designed to track the locations of users in a workplace. The number of active badges depends upon the number of users. Preferably, each active badge has a unique identification code 12*a* that corresponds to the user wearing the badge. The system 10 operates on the premise that a person desiring to be located wears the active badge 12. The badge 12 emits a unique digitally coded infrared signal that is detected by the network of sensors 14, approximately once every fifteen seconds, preferably.

Active badges are known; however, those known operate on the premise that individuals spend more time stationary than in motion and, when they move, it is at a relatively slow rate. Accordingly, the active badges 12 preferably have a beacon period of about 5 seconds. This increased frequency results in badge locations being determined on a more regular basis. As those skilled in the art will appreciate, this increase in frequency also increases the likelihood of signal collision. This is not considered to be a factor if the number of users is few; however, if the number of users increases to the point where signal collision is a problem, it may be advantageous to slightly increase the beacon period.

The sensors 14 are placed throughout the subject environment (preferably the workplace) at locations corresponding to areas that will require the system 10 to feed back information to the user based upon activity in a particular area. For example, a sensor 14 may be placed in each room and at various locations in hallways of a workplace. Larger rooms may contain multiple sensors to ensure good coverage. Each sensor 14 monitors the area in which it is located and preferably detects badges 12 within approximately twenty-five feet.

Badge signals are received by the sensors 14, represented in the block diagram of FIG. 5, and stored in a local FIFO memory 14*a*. It should be appreciated that a variety of suitable sensors could be used as those skilled in the art will appreciate. Each sensor 14 preferably has a unique network identification code 14*b* and is preferably connected to a wired network of at least 9600 baud that is polled by a master station, referred to above as the pollers 16. When a sensor 14 is read by a poller 16, it returns the oldest badge sighting contained in its FIFO and then deletes it. This process continues for all subsequent reads until the sensor 14 indicates that its FIFO is empty, at which point the poller 16 begins interrogating a new sensor 14. The poller 16 collects information that associates locations with badge IDs and the time when the sensors were read.

As with the known active badges, known pollers operate on the premise that individuals spend more time stationary than in motion and, when they move, it is at a relatively slow rate. Accordingly, in the preferred embodiment, the speed of the polling cycle is increased to remove any wait periods in the polling loop. In addition, a single computer (or a plurality of computers, if necessary) is dedicated to polling to avoid delays that may occur as a result of the polling computer sharing processing cycles with other processes and tasks.

A large workplace may contain several networks of sensors 14 and therefore several pollers 16. As a result, to provide a useful network service that can be conveniently accessed, the poller information is centralized in the location server 18. This is represented in FIG. 4.

Location server 18 processes and segregates the badge identification/location information data and resolves the information into human understandable text. Queries can then be made on the location server 18 in order to match a person or a location, and return the associated data. The location server 18 also has a network interface that allows other network clients, such as the audio server 20, to use the system.

Referring now to FIG. 6, a functional diagram of the location server 18 is shown. The location server 18 collects data from the poller 16 (block 181) and stores this data by way of a simple data store procedure (block 182). The location server 18 also functions to respond to non-audio network applications (block 183) and sends data to those applications. The location server 18 also functions to respond to the audio server 20 (block 184) and send data thereto via remote procedure calls (RPC).

Audio server 20 is the so-called nerve center for the system. In contrast to the location server 18, the audio server 20 provides two primary functions, the ability to store data over time and the ability to easily run complex queries on that data. When the audio server 20 starts, it creates a baseline table ("csight") that is known to exist at all times. This table stores the most recent sightings for each user.

After the server 20 has updated each table with new positioning data, it executes all queries for service routines 22*a–c*. If any of the queries have hits, it notifies the appropriate service routine and feeds it the results. Service routines 22*a–c* can also request an ad hoc query to be executed immediately. This type of query is not installed and is executed only once.

Figure 7:
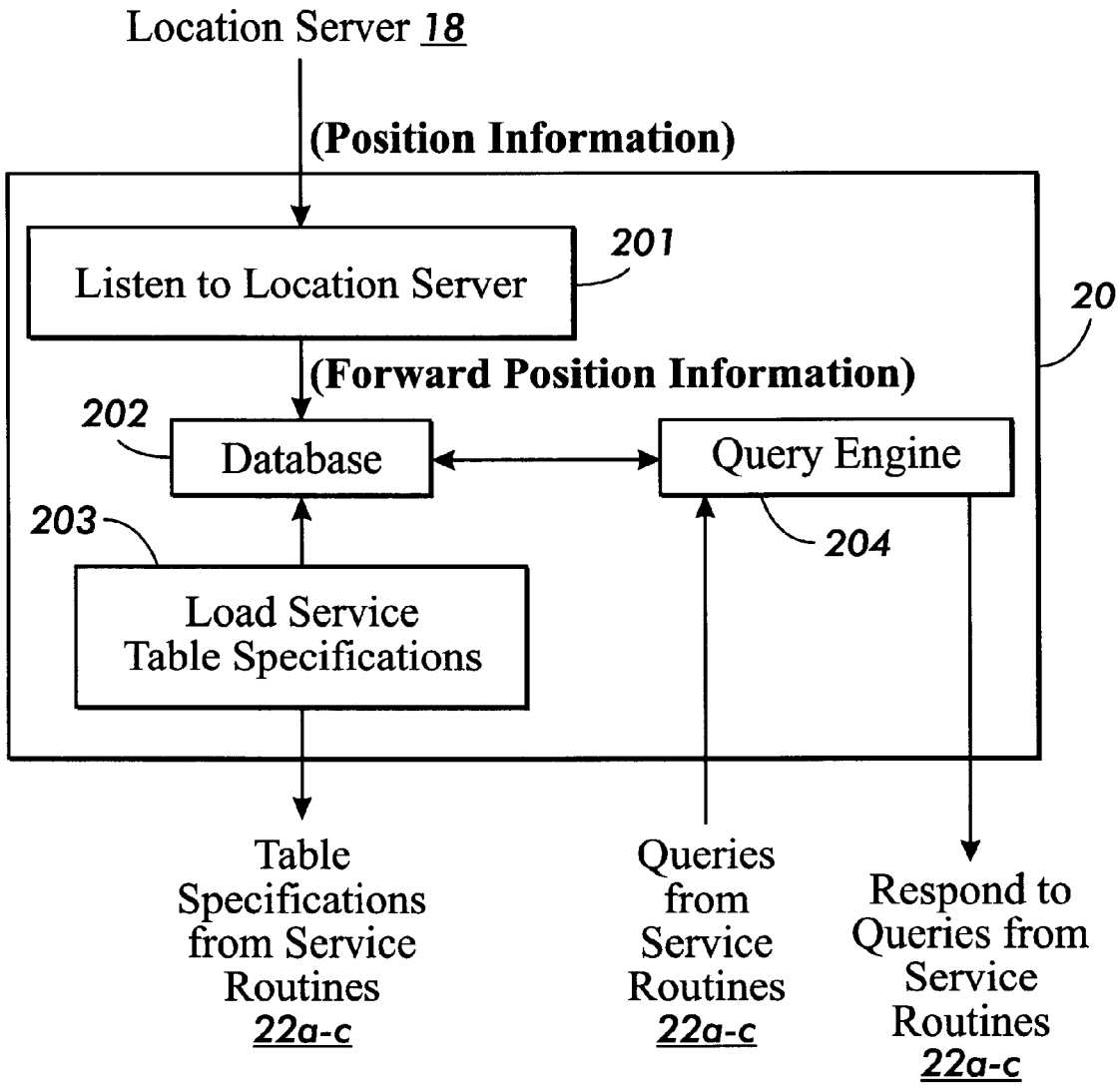
FIG. 7 is a functional block diagram illustrating an audio server according to the present invention.

Referring now to the functional diagram of FIG. 7, the audio server 20 listens to the location server 18 by gathering position information therefrom (block 201) and forwarding the position information to a database (block 202). The database also has loaded therein table specifications from the service routines 22*a–c* (block 203). In addition, as shown, the audio server 20 is provided with a query engine (block 204) that receives queries from the service routines 22*a–c* and responses to queries from the service routines 22*a*–22*c*.

In the preferred embodiment, a location server 18 and an audio server 20 are provided. However, it should be recognized that these two servers could be combined so that only a single server is used. For example, a location server thread or process and an audio server thread or process can run together on a single server computer.

The actual code for the audio server 20 is written in the Java programming language and communicates with the location server 18 via RPC. For convenience, this Java programming language code (as well as that for the service routines) utilized in the preferred embodiment is attached hereto as Appendix A. In this regard, a portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Most of the computation occurs within the audio server 20. This centralization reduces network bandwidth because the audio server 20 need not update multiple data repositories each time it obtains new data. The audio server 20 need only send data over the network when queries produce results. This technique also reduces the load on client, or user, machines.

Audio service routines 22*a–c* are also written in Java (refer to Appendix A) and 1) inform the audio server 20 via remote method invocation (RMI) what data to collect and 2) provide queries to run on that data. That is, when a service routine 22*a–c* is registered with the audio server 20, two things are specified—data collection specifications and queries. After a service routine 22*a–c* starts the data specification and queries are communicated to the audio server 20, the service routine 22*a–c* simply awaits notification of the results of the query.

The service routines 22*a–c* correspond to the three primary exemplary applications discussed herein, i.e. e-mail, footprints, and group pulse. It should be understood that any number or type of service routines could be implemented to meet user needs.

Each of the data collection specifications results in the creation of a table in the server 20. The data specification includes a superkey, or unique index, for the table as well as a lifetime for that table. As noted above, when the server 20 receives new data, the specification is used to decide if the data is valid for the table and if it replaces other data.

Queries to run against the tables are defined in the form of a query object. This query language provides the subset of structured query language (SQL) relevant to the task domain. It supports cross products and subsets, as well as optimizations, such as short-circuit evaluation.

When queries to the audio server 20 result in "hits", the audio server 20 returns the results to the appropriate service routines 22*a–c*. A returned query from the audio server 20 may result in the service routine playing an auditory cue via transmitter 28, gathering other data, invoking another program and/or sending another query to the audio server 20.

The pseudo-code for implementing a service routine is as follows:

```
Connect to audio server
Load in user configuration (identity, sound, parameters, constraints)
    identity (who is this user, what is their office number)
    sound is what sounds the user would like to play;
    parameters such as:
        how much is "a little" e-mail
        in "what location" does the user hear the group pulse
        location of Email queue
    constraints such as lifetime of data
Create table specifications
    for n tables
        specify name of table
        specify column definitions (e.g., user,
        location, time, confidence)
        specify lifetime
Build queries
    for m queries
        specify table
        specify query type (normal, crossproduct)
        specify interval
        specify result form (records, count)
        specify clauses (field/value pairs)
Send table and query specifications to audio server
Load sounds
Wait for query match ( ); {waiting for an RMI message}
Receive query-match message
    decode data
        set local data (e.g., time last entered loc-x)
    if needed, submit another query
    if needed, pull in additional information (e.g.,
    status of e-mail queue)
    if appropriate, trigger sound output
```

As Java applications, these service routines 22*a–c* can also maintain their own state as well as gather information from other sources. Referring back to FIG. 4, an e-mail resource 24 and a resource 26 indicating the activity of other members of the user's work group are provided.

The query language in the present system is heavily influenced by the database system used which, in the preferred embodiment, is modeled after an Intermezzo system. The Intermezzo system is described in W. Keith Edwards, *Coordination Infrastructure in Collaborative Systems*, Ph.D. dissertation, Georgia Institute of Technology, College of Computing, Atlanta, Ga. (December 1995). Additional discussions can be found on the Internet at www.parc.xerox.com/csl/members/kedwards/intermezzo.html. It should be recognized that any suitable database would suffice. This language is the subset of SQL most relevant to the task domain, supporting the system's dual goals of speed and ease of authoring. A query involves two objects: "AuraQuery", the root node of the query that contains general information about the query as a whole, and "AuraQuery Clause", the basic clause that tests one of the fields in a table against a user-provided value. All clauses are connected by the boolean AND operator.

As an example, the following query returns results when "John" enters room 35-2107, the Bistro or coffee lounge. First, the query is set with attributes, such as its ID, what table it refers to, and whether it returns the matching records or a count of the records. The clauses in the query are described by specifying field-value pairs. The pseudocode for specifying a query is as follows:

```
auraQuery aq;
auraQueryClause aqc;
aq=new auraQuery( );
/* ID we use to identify query results */
aq.queryId = 0;
/* current sightings table */
aq.queryTable = "csight";
/* NORMAL or CROSS_PRODUCT */
aq.queryType = auraQuery.NORMAL;
/* return RECORDS or a COUNT of them */
aq.resultForm = auraQuery.RECORDS
/* we've seen John */
aqc = new auraQueryClause ( );
aqc.field = "user;
aqc.cmp = auraQueryClause.EQ;
aqc.val = "John";
aq.clauses.addElement (aqc);
/*John is in the bistro */
aqc=new auraQueryClause( );
aqc.field = "locID";
aqc.cmp = auraQueryClause.EQ;
aqc.val = "35-2107";
aq.clauses.addElement (aqc);
/*John just arrived in the bistro */
aqc=new auraQueryClause ( );
aqc.field = "newLocation";
aqc.cmp = auraQueryClause.EQ;
aqc.val = "new Boolean (true)";
aq.clauses.addElement (aqc);
```

As alluded to above, if a query is satisfied and the resultant action is the transmission of an audio cue, the transmitter 28 transmits the audio signal to wireless headphones 30 that are worn by the user that performed the physical action that prompted the query. Of course, as those of skill in the art will appreciate, many different types of communication hardware might be used in place of the RF transmitter and wireless headphones, or earphones.

The system 10 is, of course, configurable to meet specific user needs. Configuration of the system is accomplished by, for example, editing text files established for specifying parameters used by the service routines 22*a*–22*c*.

In addition to configuring the system by editing text files, the present invention also describes and illustrates, as shown in FIG. 11, virtual interface 32 implemented on computer 33, is used to configure and re-configure audio aura system 10. Virtual interface 32 is connected to audio aura system 10 through data links 34 by known data transmission techniques. The configuration and operation of virtual interface 32 and data links 34 as applied to audio aura system 10 will be discussed in more detail in connection with FIGS. 12–16D in the following pages of this document.

Figure 8:
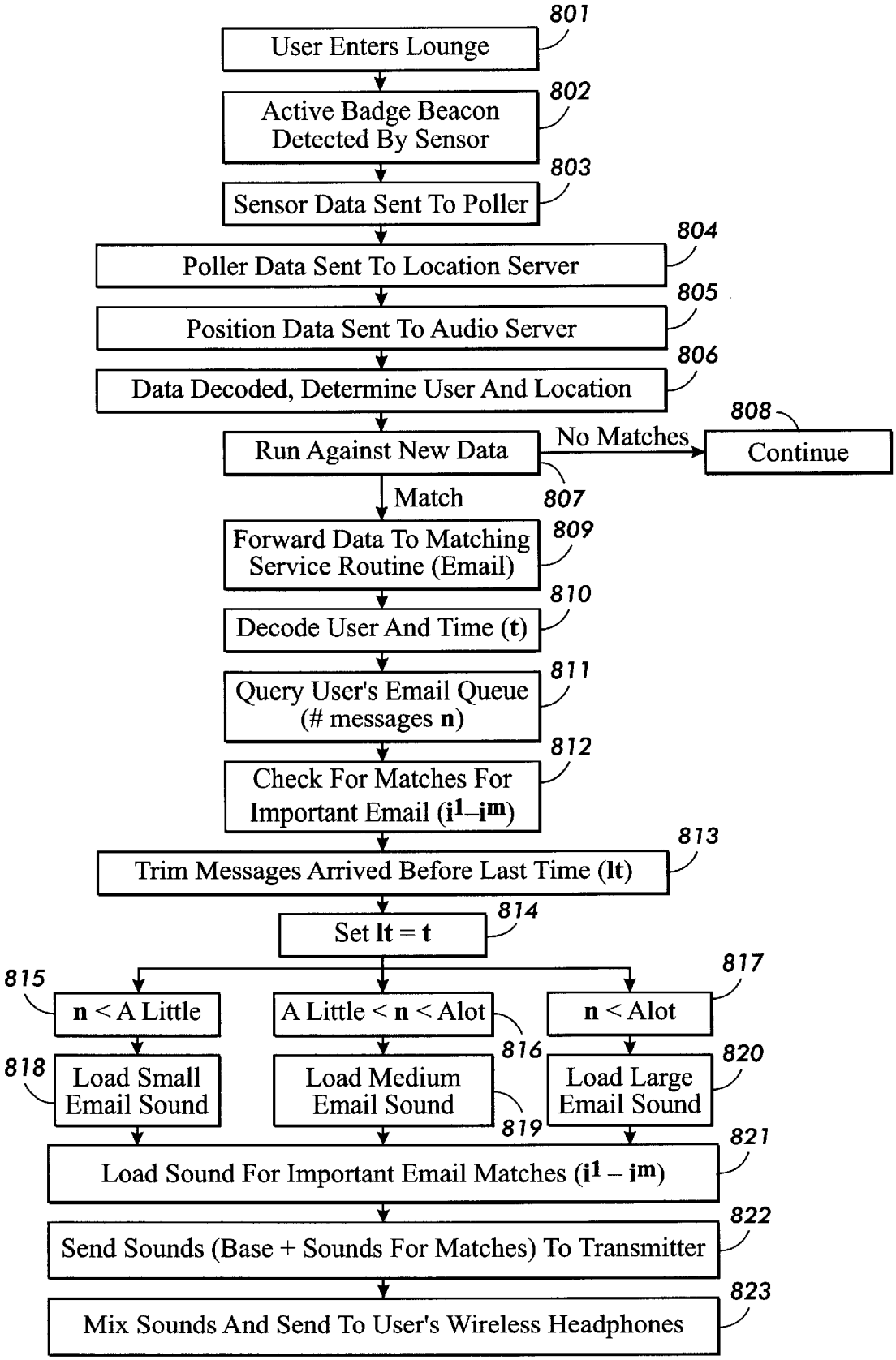
FIG. 8 is a flow chart showing an exemplary application of the present invention.
Figure 9:
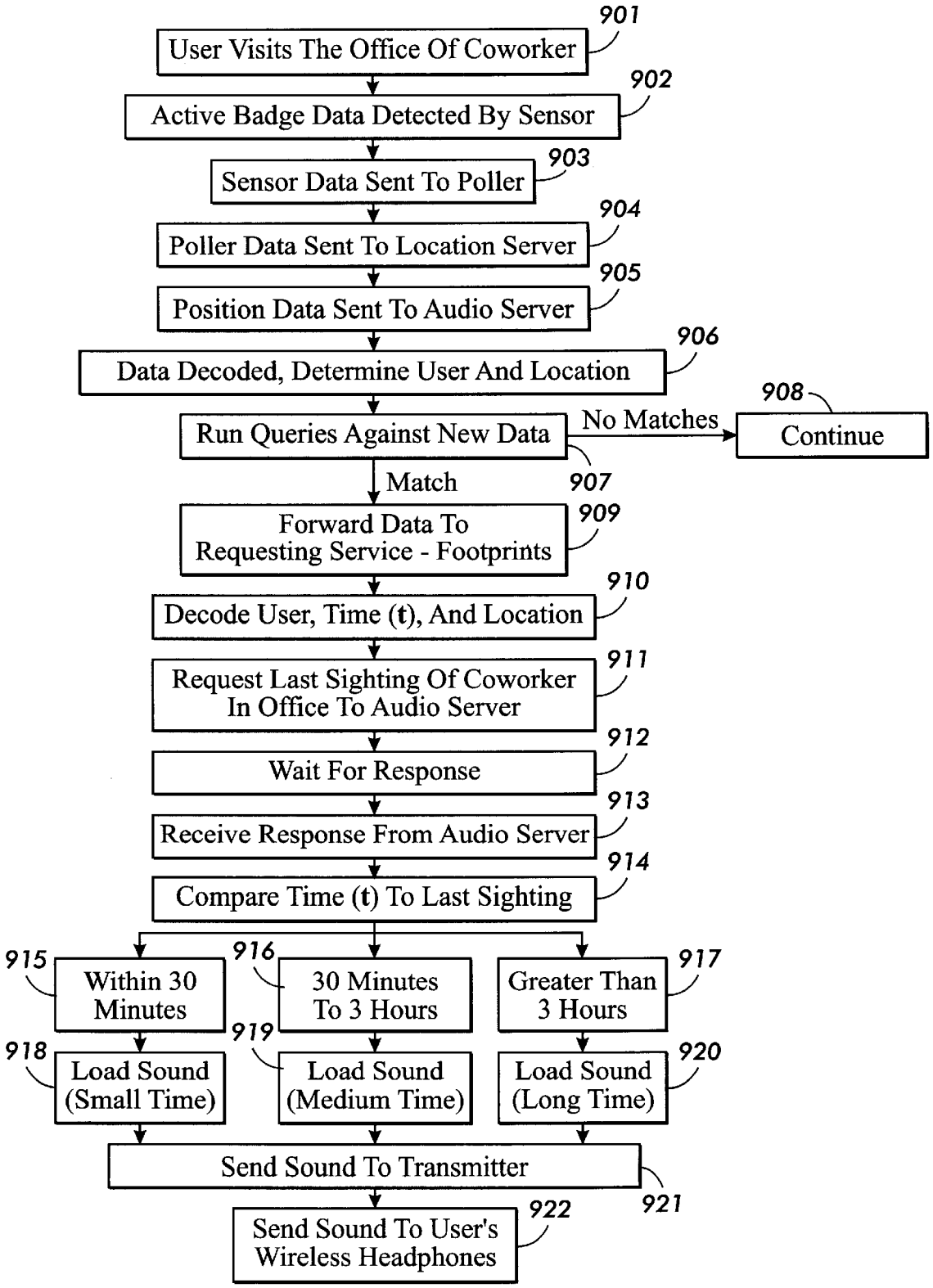
FIG. 9 is a flow chart showing an exemplary application of the present invention; and, FIG. 10 is a flow chart showing an exemplary application of the present invention.
Figure 10:
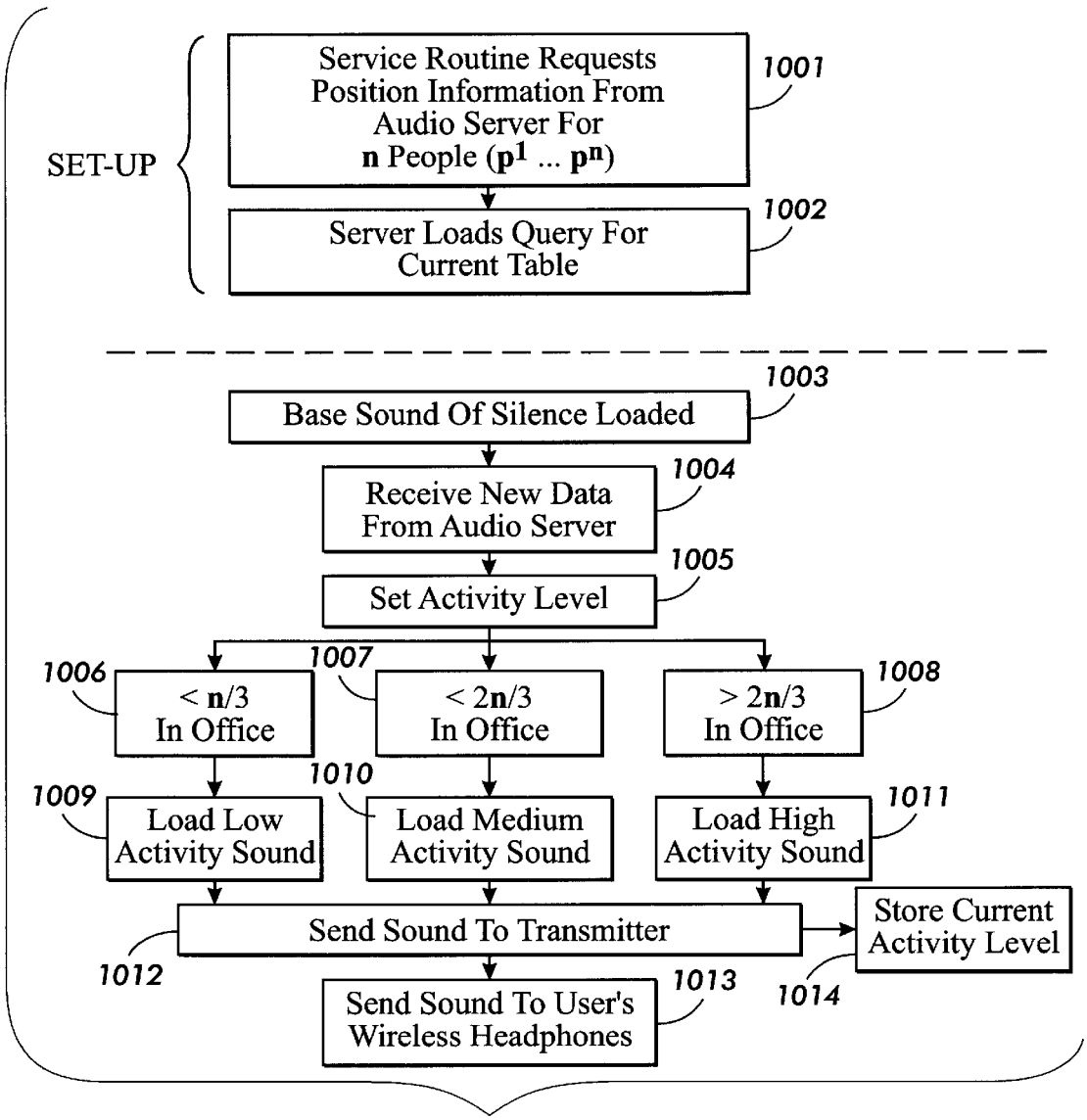

Having thus described the components and other aspects of the system 10, the operation (or select methods) of the system upon a detection of a user engaging in a conduct that triggers the system is illustrated in the flowcharts of FIGS. 8–10. More particularly, the "e-mail" scenario, "footprint" scenario, and "group pulse" scenario referenced above are described.

With reference to FIG. 8, a user enters a room, e.g. the coffee lounge,(step 801) and the active badge 12 worn by the user is detected by the sensor 14 located in the coffee lounge (step 802). The sensor data is collected by the poller 16 (step 803) and sent to the location server 18 (step 804). Position data processed by the location server 18 is then forwarded to the audio server 20 (step 805) where the data is decoded and the identification of the user and the location of the user is determined (step 806). Queries are then run against the data (step 807). If no matches are found, the system continues to run in its normal state (step 808). If, however, matches are found, the data is forwarded to the e-mail service routine 22*a* (step 809). The system then decodes the user identification and the time (t) that the user entered the lounge (step 810). The user's e-mail queue is then queried (# messages =n) (step 811). A check is then made for "important" e-mail messages (step 812). The system then trims the messages that arrived before the last time (lt) that the user entered the lounge (step 813) and lt is then set equal to t (step 814). It is then determined whether the number of messages is less than a little, between a little or a lot, or greater than a lot (steps 815–817). Then, respective sounds that correspond to the number of e-mail messages are loaded (steps 818–820). Sounds are also loaded for "important" messages (821) and all sounds are then sent to transmitter 28 (step 822). Sounds are then mixed and sent to wireless headphones 30 worn by the user (step 823).

Referring now to FIG. 9, the application of the system wherein a user visits the office of co-worker i.e. "footprints" application, is illustrated. As shown, a user visits a co-workers office (step 901) and the active badge worn by the user is detected by the sensor 14 in the office (step 902). The sensor data is then sent to poller 16 (step 903), the poller data is sent to the location server 18 (step 904), and position data is then sent to the audio server 20 (step 905). The data is then decoded to determine the identification of the user and the location of the user (step 906). Queries are then run against the new data (step 907) and, if no match is found,.the system continues normal operation (step 908). If a match is found, data is forwarded to the footprints service routine 22b (step 909). The user identification, time (t) that the user visited the office and location of the user are then decoded (step 910). A request is then made to determine the last sighting of the co-worker in her office to the audio server 20 (step 911). The system then awaits for a response (step 912). When a response is received from the audio server 20 (step 913) the time (t) is then compared to the last sighting (step 914). The comparison determines whether the last sighting was within 30 minutes, between 30 minutes and 3 hours, or greater than 3 hours (steps 915–917). Accordingly, corresponding appropriate sounds are then loaded (steps 918–920). The sounds are sent to the transmitter 28 (step 921) and consequently to the users headset (step 922).

The group pulse is monitored as follows. Referring to FIG. 10, the system is initialized by requesting position information from the audio server 20 for n people ($p^1 \ldots p^n$)(step 1001). The server 20 loads the query for the current table (step 1002). In operation, a base sound of silence is loaded (step 1003). New data is then received from the audio server 20 (step 1004). An activity level (a) is then set (step 1005). A determination is then made whether the activity level is low, medium, or high (steps 1006–1008). As a result of the determination of the activity level, activity sounds are loaded (steps 1009–1011). The sounds are then sent to the transmitter 28 (step 1012) and to the users wireless headphones (step 1013). The activity level is also stored as the current activity level (step 1014).

Importantly, because this system is intended for background interaction, the design of the auditory cues preferably avoids the "alarm" paradigm so frequently found in computational environments. Alarm sounds tend to have sharp attacks, high volume levels, and substantial frequency content in the same general range as the human voice (200–2,000 Hz). Most sound used in computer interfaces has (sometimes inadvertently) fit into this model. The present system deliberately aims for the auditory periphery, and the system's sounds and sound environments are designed to avoid triggering alarm responses in listeners.

One aspect of the design of the present system is the construction of sonic ecologies, where the changing behavior of the system is interpreted through the semantic roles sounds play. For example, particular sets of functionalities can be mapped to various beach sounds. In the current sound effects design, the amount of e-mail is mapped to seagull cries, e-mail from particular people or groups is mapped to various beach birds and seals, group activity level is mapped to surf, wave volume and activity, and audio footprints are mapped to the number of buoy bells.

Another idea explored by the system in these sonic ecologies is imbedding cues into a running, low level soundtrack, so that the user is not startled by the sudden impingement of a sound. The running track itself carries information about global levels of activity within the building or within a work group. This "group pulse" sound forms a bed within which other auditory information can lie.

One useful aspect of the ecological approach to sound design is considering frequency bandwidth and human perception as limited resources. Given this design perspective, sounds must be built with attention to the perceptual niche in which each sound resides.

Within each design model, several different types of sounds, variation of harmonic content, pitch, attack and decay, and rhythms caused by simultaneously looping sounds of different lengths, were created. For example, by looping three long, low-pitched sounds without much high harmonic content and with long, gentle attacks and decays, a sonic background in which room is left for other sounds to be effectively heard is created. In the music environment this sound if a low, clear vibe sound; in the sound effects environment it is distant surf. These sounds share the sonic attributes described above.

The system offers a range of sound designs: voice only, music only, sound effects only, and a rich sound environment using all three types of sound. These different types of auditory cues, though mapped to the same type of events, afford different levels of specificity and required awareness. Vocal labels, for example, provide familiar auditory feedback; at the same time they usually demand more attention than a non-speech sound. Because speech intends to carry foreground information, it may not be appropriate unless the user lingers in a location for more than a few seconds. For a user who is simply walking through an area, the sounds remain at a peripheral level, both in volume and in semantic content. Of course, it is recognized that there may be instances where speech is entirely appropriate, e.g., auditory cue Q4 in FIG. 2.

The preceding discussion focused on implementation and operation of audio aura system 10. It is appreciated by the inventors, however, that the desirability of such a described system increases by insuring the system is easily configurable and flexible. Specifically, in an office, school or home setting, there will be a turnover of employees, students or owners. Therefore, audio aura system 10 needs to have the flexibility to add and delete users. It is also recognized that such a system needs to be configurable to the personal habits and needs of users. For instance, while in the preceding examples some users may have wanted to receive an indication of their e-mail upon entering the "bistro", other users may not want such an audio cue at this location. Therefore, it has been considered useful to provide flexibility which allows individuals to achieve customization of the audio aura system. If the requirements to reconfigure the system are complex and involved, then an individual will be resistant to implementation of the system. Also if reconfiguring the system is complex then it will be necessary to have a designated individual that makes the changes. However, this diminishes the flexibility of the overall system as all changes must then be routed through a single individual in charge of this task, which is considered by the inventors to be a less than desirable manner of implementation.

Therefore, the inventors have designed, as illustrated in FIG. 11, a virtual interface 32 which connects to audio aura system 10 through data links 34. Virtual interface 32 is implemented on a computer 33 such as a desktop or laptop computer having a display screen and sound capabilities.

In developing audio aura system 10, the inventors generated designs by using computer prototyping, and in particular they used Virtual Reality Modeling Language 2.0 (VRML 2.0). VRML 2.0 is a data protocol that allows real time interaction with 3D graphics and audio in web browsers. Further discussions concerning this language are set forth in the document by Ames, A., Nadeau, D., Moreland, J., The VRML 2.0 Source Book, Wile, 1996, and also may be found on the VRML Repository at http://www.sdsc.edu/vrml.

Mapping audio aura's matrix of system behaviors to a multi-layered sound design greatly aided the prototyping efforts. By moving through a 3D graphical representation of a target area, and triggering audio cues either through proximity or touch, a sound designer was able to obtain a sense of how well the sounds map to the functionality of the audio aura system 10 and how well the different sounds cooperated.

During prototyping, the inventors have used a 3D model of a target area, including representations of sensors to realize different sound designs of the VRML prototypes including:

Voice World: voice labels on a doorway for each office of a target area provide the rooms, name or number, e.g., "Library" or "2101." These labels are designed as defaults and are meant to be changed by the current occupant of the room, e.g., "Joe Smith." This environment was useful for testing how the proximity sensors and sound fields overlapped as illustrated, for example, in FIG. 12, as well as exploring using the audio aura prototype as a navigational aid. With more particular attention to FIG. 12, a depiction is set forth of VRML sensor and sound geometry. Box 36 shows the proximity sensor coverage for inside the office model. Sphere 38 shows the accompanying sound ellipse, the ellipse defining a virtual area within which sound is audible. Each office in this environment has such a system both for its interior and for its door into the hallway. Thus, FIG. 12 illustrates the area coverage of a sensor or sensor cluster.

Sound Effects World: This design makes use of an "auditory icon" model of auditory display where meaning is carried through sound sources. Such a icon may be a soundscape of a beach, where group activity is mapped to wave activity, e-mail amount is mapped to amount of seagull calls, particular e-mail centers are mapped to various beach animals such as different birds and seals, and office occupancy history "i.e. audio footprints" is mapped to buoy bells.

Music World: This design makes extended use of the "earcon" model of auditory display, where meaning is carried through short melodic phrases or musical treatments. Here, the amount of e-mail is indicated by the changing melodies, pitches and rhythm of a set of related short phrases. The "family" of e-mail quantity sounds consists of differing sets of fast arpeggios on vibes. A different family of short phrases, this time simple, related melodies on bells, are mapped to audio footprints. Again, though the short melodies are clearly related to each other, the qualitative information about office occupancy is carried in each phrase's individual shifts in melody, rhythm and length. Finally, a single low vibe sound played at different pitches portrays the group activity level. One aspect of the use of earcons is that they do require some learning. For example, which family of sounds is mapped to what kind of data and within each family, what the differences mean. In general we opted for the simplest mappings, e.g. more (notes) means more (mail).

Rich World: The rich environment combines sound effects, music and voice into a rich, multi-layered environment. This combination is the most powerful because it allows wide variation in the sound palette while maintaining a consistent feel. However, this environment also requires the most careful design work, to avoid stacking too many sounds within the same frequency range or rhythmic structure During the prototyping process the inventors also determined that, for prototyping, the sensor arrays in the VRML prototype should not exactly replicate the sensor network in the target area previously described. First, the inventors considered noting the physical location of each real world sensor and then creating an equivalent sensor in the VRML world. However, the characteristics of the VRML sensors as well as the characteristics of the VRML sound playback were not considered compatible with this design model. For example, the real sensors often require line-of sight input, and wireless headphones do not have a built-in mapping to proximity. Specifically, if you are walking away from a sound's location, it does not automatically diminish the volume, as typically occurs in a VRML model. Because the inventor's intent in building these VRML prototypes was to understand the sonic behavior of the system, the goal was to build a set of VRML sensors and actuators that would reasonably approximate rather than replicate the behavior of the sensors and the audio aura servers. The interest of the inventors during the prototyping was to determine who the user was, where the user was located and at what time, within a granularity of a few feet. It was also necessary to be able to transmit sounds based on that information.

The same set of sounds that were used in the VRML prototypes were then loaded directly to the audio aura servers.

Based on the use of this prototyping, the inventors understood the benefits of extending the prototype for use as a virtual interface for a real world implemented audio aura system 10.

Figure 13:
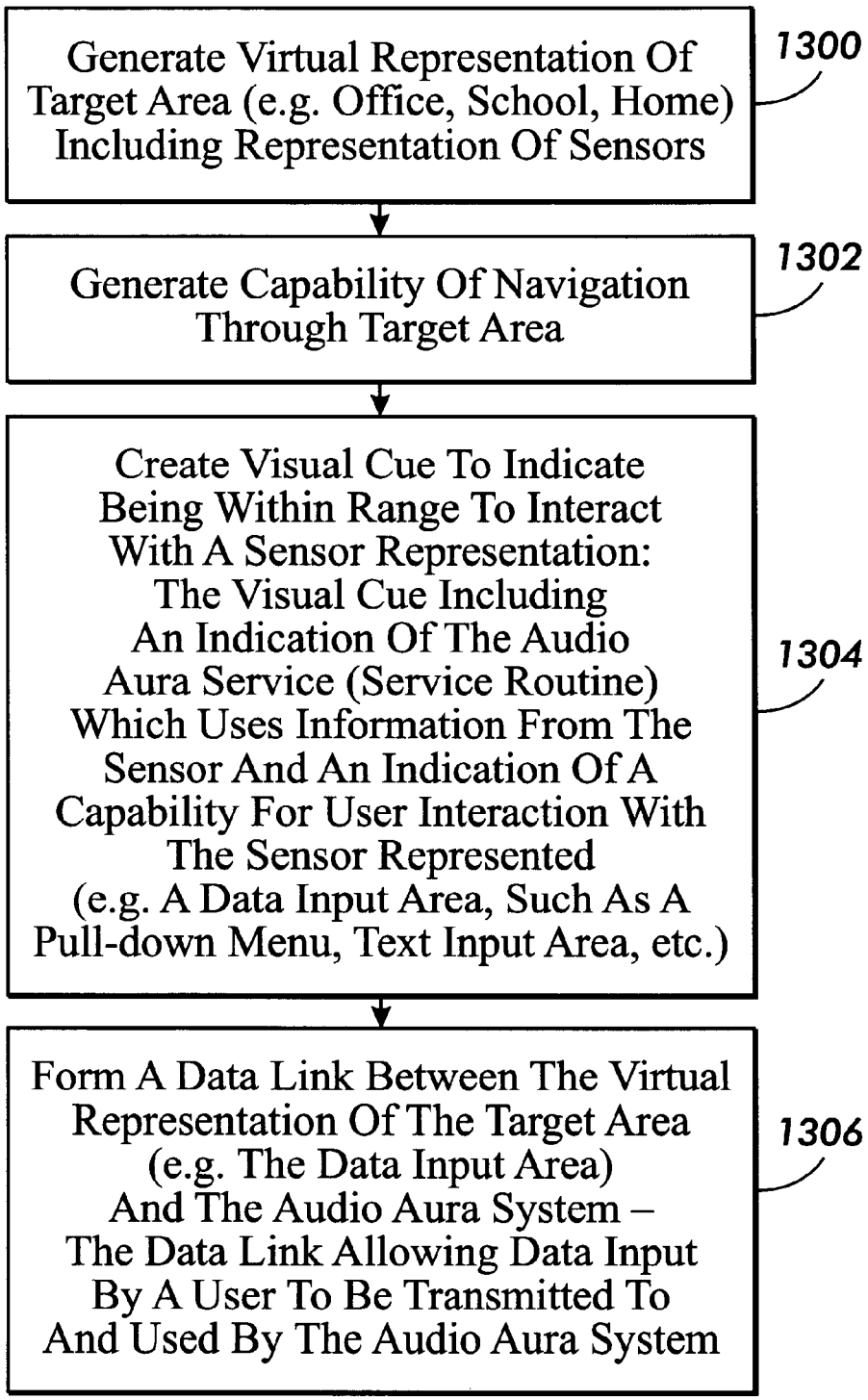
FIG. 13 is a flow chart illustrating the generation of the virtual interface used in the present invention.

In particular, FIG. 13 illustrates a flow chart depicting steps for the generation of the virtual interface 32 in accordance with the present invention.

In step 1300, a virtual representation of the target area such as an office, school, home, etc is generated. This representation includes a representation of the sensors of the present invention.

It is noted that while during the prototyping the VRML prototype did not replicate the sensor network, embodiments of the virtual interface of the present invention in the target area can be generated to accurately replicate each sensor location. In alternative embodiments, a sensor system which approximates operation of real world sensors—without replicating exact positions, etc.—may be implemented similar to that done in the prototyping. Specifically, whereas in the real world system there may be several sensors in the "bistro", embodiments of the present invention can implement each individual sensor, or alternatively provide an indicator as to the presence of a sensor array or cluster.

The virtual interface is designed with navigation capabilities for moving through the target area (1302). This concept is required to allow the user to be immersed into the virtual target area. Techniques to provide navigation are well known in the art and various ones of these techniques would be appropriate for the present invention.

A next step (1304) in the process includes creating visual cues to indicate navigation has placed a user within a range to interact with the sensor representation. Specifically, either a representation of a sensor or an image representing a sensor cluster. The visual cue includes an indication of which of the service routines will use the information provided by that sensor or sensor cluster. Particularly as previously discussed, the sensors provide data used within audio aura system 10. As discussed in connection with FIG. 4, data from at least one of sensors 14 is used to cause one of the audio aura services (also called service routine) 22*a* through 22*c* to perform an appropriate operation. In the audio aura system 10 it is also possible that a particular sensor or sensor cluster can be used by more than one of the audio aura services. Therefore, in generating the virtual interface 32 it is beneficial to have a visual cue which allows a user to understand the audio aura services which will be called when the user is sensed by that particular sensor. Further, an indication of a capability for user's interaction with the sensor representation is also provided. This is a data input area such as a pull-down menu, a text entry block or some other manner of entering information to the virtual interface.

Since a concept of the present invention is to improve the ease with which audio aura system 10 may be reconfigured, a data link exists between the virtual interface and the audio aura system (1306). The data link is configured to allow data which has been input by a user to be transmitted to and stored within the audio aura system 10.

Once virtual interface 32 has been constructed in accordance with the steps of FIG. 13, it is possible for a user to alter the system configuration for customization to their needs.

Figure 14A:
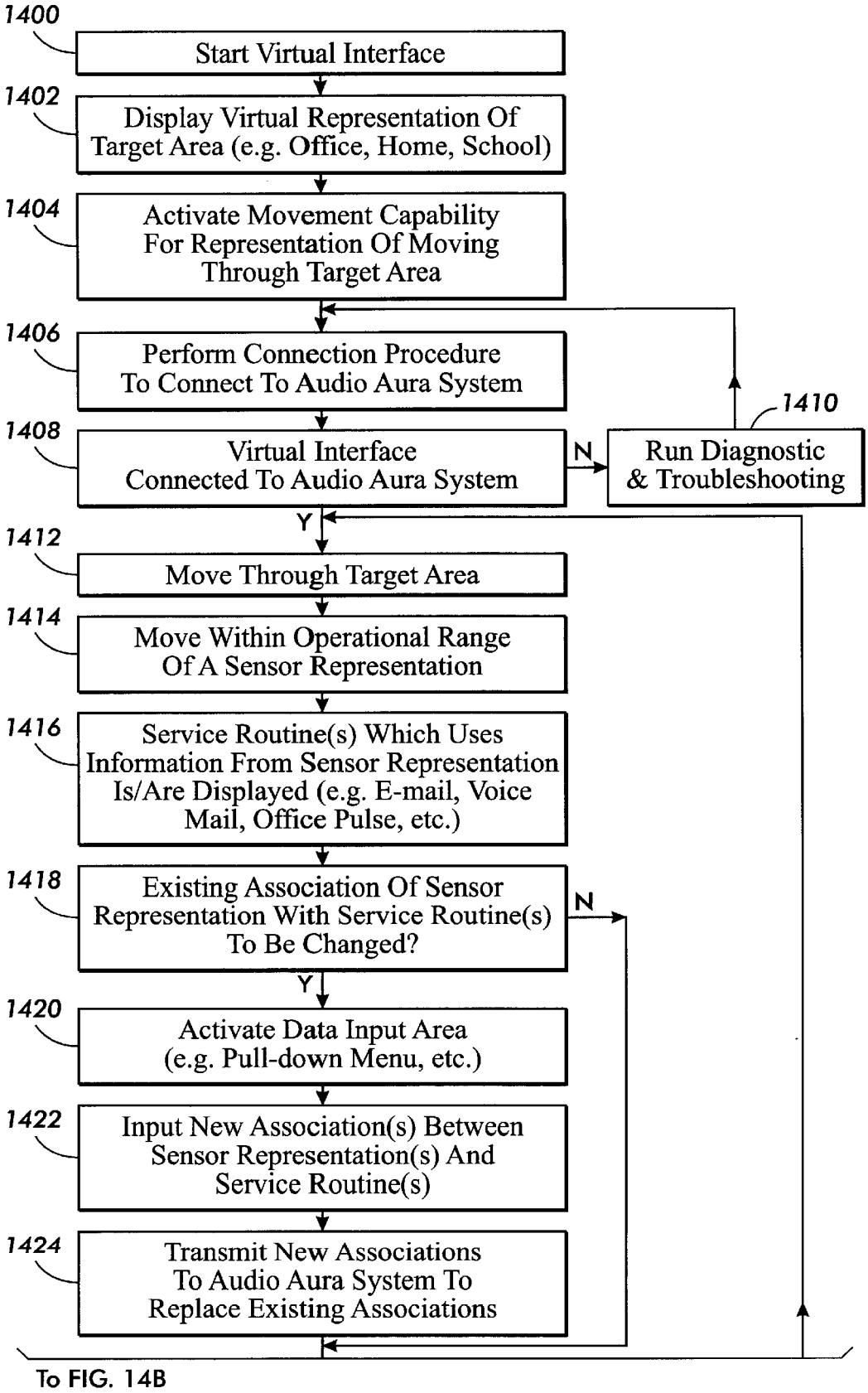
FIGS. 14A and 14B illustrate a generic operation of the virtual interface to adjust the characteristics or configuration of the audio or a system.
Figure 14B:
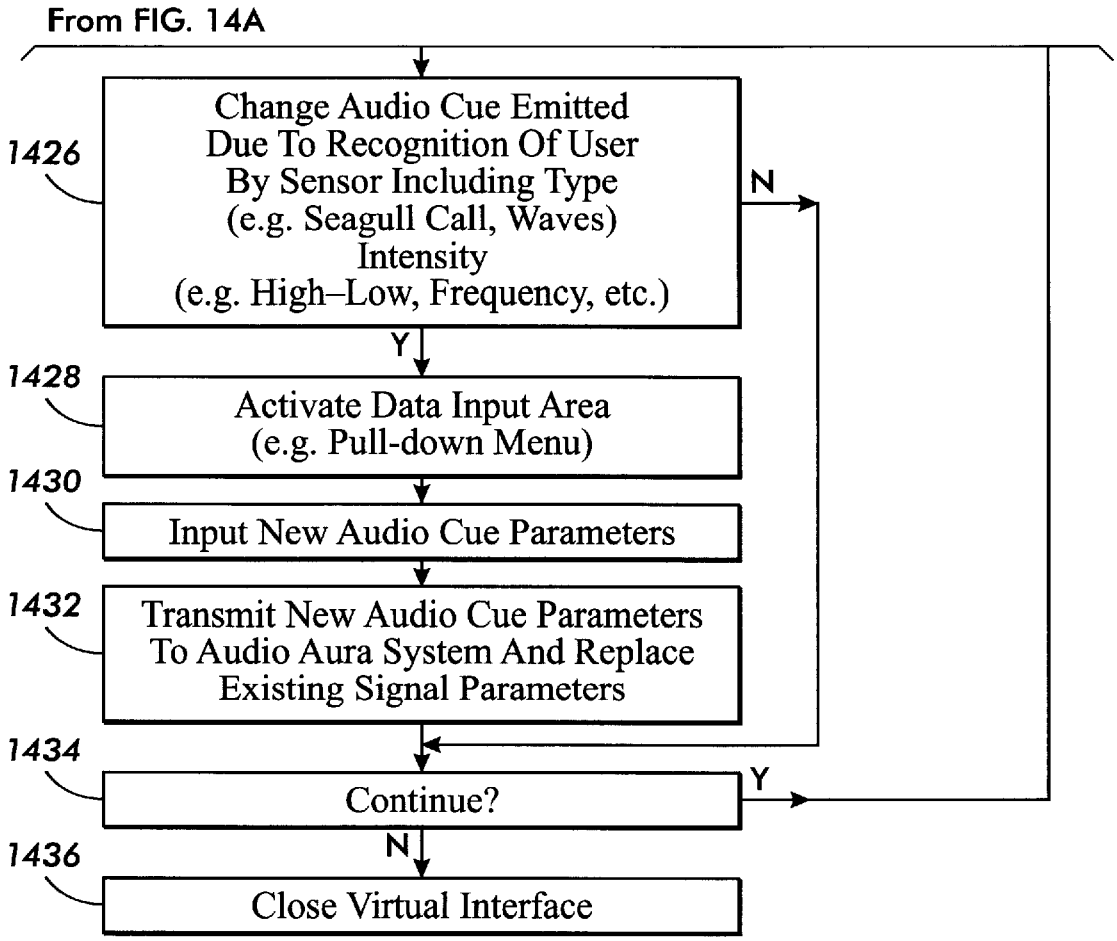

FIGS. 14A and 14B illustrate the flow of the virtual interface. In step 1400, the virtual interface is activated. As part of this operation, a display device displays a virtual representation of the target area (1402). Navigation capabilities are activated to allow a user to move through target area (1404). This navigation allows a user to move through hallways, into cubicles and into other office areas such as in a real world situation. The interface then acts to confirm connection to the audio aura system (1406) such as through the use of the data links discussed in connection with FIG. 11. If the virtual interface program determines that it is not connected to the audio aura system (1408) the interface moves to a run diagnostic and trouble-shooting block (1410) to determine the reason connection has not been achieved. The interface next ensures connection to the audio aura system. It is to be appreciated that the actions described in Steps 1402–1408 could also occur in an alternative order. For example, connection—and checking for the connection—to the audio aura system can be implemented before displaying the virtual representation of the target area. If it is determined a proper connection has been made, a user will navigate through a target area (1412). When the user moves within an operational range of a sensor representation (1414), an indication is displayed showing which service routine will use the information obtained by the particular sensor or sensor cluster. Information from the sensor or sensor cluster, for example, may be used by one of the audio aura service routines such as e-mail, location of a group member, the pulse of an office, etc.

Upon viewing the audio aura service associated with the particular sensor or sensor cluster, a user will determine whether or not they wish to alter this arrangement (1418). If the user wishes to maintain the association as it now exists, blocks 1420–1424 are skipped. On the other hand, if the association is to be altered, the program proceeds to block 1420 where a user data input area is activated, such as a pull-down menu, a data input area, etc. In accordance with the particular configuration of the data input area, the user can adjust the association presently existing (1422). The inputted data is then transmitted via the data links to the audio aura system where the existing associations between the sensors or sensor clusters and the audio aura services are altered to the newly inputted associations (1424).

Particularly, in the preceding example, if the existing system configuration generated an audio cue for e-mail when a user entered the "bistro", this may now be changed to an indication that the user has voice mail, the office pulse, or no cue at all.

A user still within the operational range of the sensor or sensor cluster representations can also determine whether the audio signal emitted is to be changed (1426). Particularly, a user is able to alter the audio cues (for example, from seagulls to ocean waves), change the intensity of the cue, or the frequency of the audio cue.

If it is determined that the audio cue is not to be changed, then blocks 1428–1432 are skipped.

On the other hand, if the audio cues are to be altered the user can activate a user data input area (1428) and input new or alter existing audio cues (1430). This information is then transmitted (1432) to the audio aura system, replacing or altering existing audio cues.

Next, the user has an option of continuing within the virtual interface (1412) or closing the virtual interface program (1436).

Figure 15A:
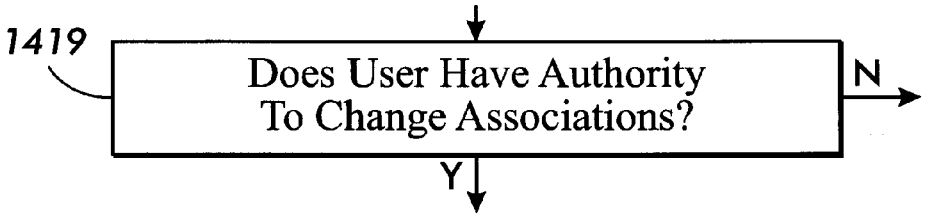
FIGS. 15A and 15B are block diagrams showing additional embodiments of the flow chart of FIG. 14.
Figure 15B:
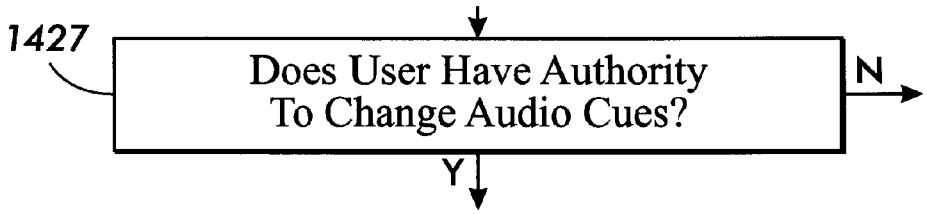

As a further embodiment of the present invention, it is to be understood that it may be beneficial to restrict users ability to change other user's sensor/service routine associations and/or audio cues. It may also be desirable to limit a user's ability to change any one of either the audio cues or associations even for themselves. Therefore, as shown in FIGS. 15A and 15B, a further embodiment to the interface program structure shown in FIGS. 14A and 14B is the inclusion of an authority check wherein the user is queried as to proper authority. The input to the authority check may be a user identification, access key or other known method of security feature. Block 1419 of FIG. 15A would follow block 1418. If the user does have proper authority, the program simply continues to flow as described in FIGS. 14A and 14B. On the other hand, if the user does not have proper authority, the user can be locked out of the system entirely or moved to a lower or alternative location such as to the changing of audio cues. A similar situation would exist for FIG. 15B wherein the authority block 1427 will follow block 1426.

By use of these blocks, control can be obtained over reconfiguration of audio aura system 10.

In the present application, a discussion is set forth regarding generation of audio cues when a user enters an office area other than their own (for example, FIG. 2). It is to be appreciated that the system contains sufficient flexibility such that the message received when entering an area of a co-worker, may be either an audio cue of the user or may be an audio cue of the co-worker. For example, a user entering an office that is not their own and where the person occupying the office has been gone "less than an hour"the audio cue supplied may be that of the user's own selection or that of the co-worker. This may become an issue especially in large offices where it may not be possible for a person to know the personalized cues of every individual in an office. Therefore the present invention provides for system-wide audio cues as well as individualized audio cues.

Figure 16A:
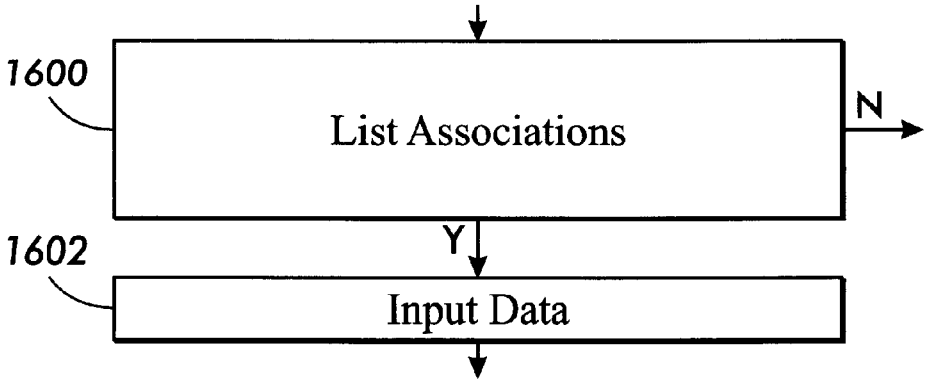
FIGS. 16A through 16D illustrate system list functions of the present invention.
Figures 16B, 16C, 16D:
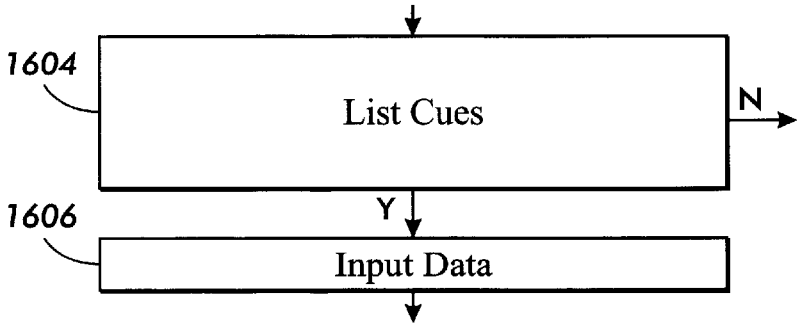

Turning attention to FIGS. 16A–16D, it is noted that in some instances a user may wish to view an overall system listing, which shows associations between all the sensor representations and audio aura services. This aspect is provided for in FIGS. 16A and 16B. In particular, in a further embodiment of the present invention a system-wide list association (1600) is undertaken, wherein a command is given to list out this information in a tabular or other human readable form. When in this mode, the user is also presented with a data input area (1602) where the user may input data which alters the associations and which are thereafter transmitted to the audio aura system. FIG. 16B illustrates one particular tabular embodiment of the system-wide list association described in connection with FIG. 16A.

The present invention has a further embodiment wherein the user can call a system-wide listing of audio cues (1604). By this operation, a system-wide listing of audio aura services and their associated audio cues are displayed in an appropriate format such as the tabular format of FIG. 16D.

In connection with the above system-wide listings, it is to be appreciated that use of the authorization components of FIGS. 15A and 15B can limit a user's ability to review the material described. In particular, a user may be limited only to data concerning their own configuration, or to only a listing of audio cues, dependent upon their level of authority.

The above description merely provides a disclosure of particular embodiments of the invention. It is not intended for the purpose of limiting the same thereto. As such, the invention is not limited to only the above described embodiments. Rather, it is recognized that one skilled in the art could conceive alternative embodiments that fall within the scope of the invention.

Having thus described the invention, we hereby claim:

1. A virtual interface to an audio augmentation system located in a physical environment, for setting parameters for operation of the audio augmentation system, the virtual interface comprising:

a data link to the audio augmentation system, providing a user with access to the audio augmentation system;

a virtual representation of a target area including representations of sensors, the representation of the target area and the representation of the sensors corresponding to a real world target area and sensors;

a navigation means for simulating movement within the target area;

a visual indicator alerting the user that they are within an operational range of one of the sensor representations;

a visual indicator informing the user of a service routine with which the sensor representation is associated;

a data input area associated with the sensor representation, wherein a user can input data, the data input area including, (i) means for altering the association between the sensor representation and a representation of a service routine of the audio augmentation system, (ii) means for altering audio cues associated with a representation of a service routine of the audio augmentation system, the altering of the audio cues including changing the type of audio cue associated with the representation of the service routine, and changing an intensity of the selected audio cue to satisfy the ability of the user to recognize the audio cue without having the audio cue enter the forward consciousness of the user;

a means for transmitting the inputted data, via the data link to the audio augmentation system located in the physical environment; and means for updating the audio augmentation system so as to store the transmitted data, wherein the user is provided with the audio cues in real world situations in accord with the data transmitted to the audio augmentation system.

2. The virtual interface according to claim 1 wherein the representations of the sensors are at least one of (i) a replication of individual sensors and (ii) an approximation of the operation of a cluster of sensors in an area.

3. The virtual interface according to claim 1 wherein the target area is displayed on at least one of a visual and auditory display of a computer.

4. The virtual interface according to claim 1 wherein the target area is a three dimensional display of a physical environment.

5. The virtual interface according to claim 1 further including a first system display, wherein a plurality of the associations between the representations of a plurality of the sensors and a plurality of the service routines of the represented target area are displayed.

6. The virtual interface according to claim 1 further including a second system display, wherein a plurality of the audio cues and a corresponding plurality of the service routines of the represented target area are displayed.

7. The virtual interface according to claim 5 wherein the first system display is a tabular display.

8. The virtual interface according to claim 6 wherein the second system display is a tabular display.

9. The virtual system according to claim 1 further including a means for checking authority of a user to enter data, wherein entry of data is denied to the user without authority.

10. A method of operating a virtual interface to alter a configuration of an audio augmentation system located in a physical environment, for setting parameters for operation of the audio augmentation system, the method comprising:

displaying a virtual representation of a target area on a display, the representation of the target area corresponding to a target area in the audio augmentation system;

providing navigation capability so as to allow simulation of movement through the target area;

performing connection procedures to form a data path between the virtual interface and the audio augmentation system;

navigating through the target area;

generating visual indicators when within operation range of a representation of a sensor in the target area, the representation of the sensor corresponding to a sensor in the audio augmentation system;

displaying associations between the representation of the sensor and representation of the service routine of the audio augmentation system;

displaying audio cues corresponding to the representation of the service routine;

inputting data altering at least one of (i) the association between the representation of the sensor and (ii) the audio cues corresponding to the representation of the service routine, the altering of the audio cues including changing the type of audio cue associated with the representation of the service routine, and changing an intensity of the selected audio cue to satisfy the users ability to recognize the peripheral signals without having the signals enter their forward consciousness; and transmitting the input data to the audio augmentation system to alter the configuration of the audio augmentation system, wherein the audio augmentation system is customized to a particular user, and the user is provided with audio cues in real world situations in accord with the data transmitted to the audio augmentation system.

11. The method according to claim 10 further including a first system display step, wherein a plurality of associations between the representations of a plurality of the sensors and a plurality of the service routines of the represented target area are displayed.

12. The method according to claim 10 further including a second system display step, wherein a plurality of audio cues and a corresponding plurality of the service routines of the represented target area are displayed.

13. The method according to claim 11 wherein the first system display step is in a tabular display format.

14. method according to claim 12 wherein the second system display step is in a tabular display format.

15. The method according to claim 10 further including a step of checking authority of a user to enter desired data, wherein when the user does not have authority data cannot be entered.

* * * * *